US007811738B2

(12) United States Patent
Shigemori et al.

(10) Patent No.: US 7,811,738 B2
(45) Date of Patent: Oct. 12, 2010

(54) IMAGE FORMING METHOD

(75) Inventors: Kazunori Shigemori, Tokyo (JP); Muneharu Ito, Tokyo (JP); Toshiyuki Nagai, Osaka (JP); Toshiro Murano, Yamanashi (JP); Fuminori Tsuruta, Yamanashi (JP); Tomoharu Takeuchi, Saitama (JP); Masahiro Ikeda, Saitama (JP); Sokuei Motoda, Saitama (JP)

(73) Assignees: Zeon Corporation, Tokyo (JP); Toyo Tire & Rubber Co., Ltd., Osaka (JP); Yamanashi Electronics Co., Ltd., Yamanashi (JP); Shin-Etsu Polymer Co., Ltd., Tokyo (JP)

( * ) Notice: Subject to any disclaimer, the term of this patent is extended or adjusted under 35 U.S.C. 154(b) by 787 days.

(21) Appl. No.: 11/628,310

(22) PCT Filed: May 31, 2005

(86) PCT No.: PCT/JP2005/010294

§ 371 (c)(1),
(2), (4) Date: Dec. 1, 2006

(87) PCT Pub. No.: WO2005/119373

PCT Pub. Date: Dec. 15, 2005

(65) Prior Publication Data

US 2007/0217820 A1 Sep. 20, 2007

(30) Foreign Application Priority Data

Jun. 1, 2004 (JP) ..... 2004-163758

(51) Int. Cl.
*G03G 15/00* (2006.01)

(52) U.S. Cl. ..... 430/125.3; 430/108.7; 430/110.1; 430/110.2; 430/110.4; 430/126.1

(58) Field of Classification Search ..... 430/126.2, 430/110.1, 110.2, 110.4, 108.7
See application file for complete search history.

(56) References Cited

U.S. PATENT DOCUMENTS 6,360,069 B1 * 3/2002 Mimura et al. ..... 399/286

(Continued)

FOREIGN PATENT DOCUMENTS

JP 63-060458 3/1988

(Continued)

OTHER PUBLICATIONS

Abstract of JP2004264359, Sep. 2004.*

(Continued)

*Primary Examiner*—Hoa V Le
(74) *Attorney, Agent, or Firm*—Westerman, Hattori, Daniels & Adrian, LLP

(57) ABSTRACT

In an image forming method including a charging step, an exposure step, a development step using a developing roll, a transfer step, a fixing step and a cleaning step of removing a toner remaining on the surface of a photosensitive member after the transfer step, the developing roll has a surface brightness of 30 to 220 and a surface roughness Rz of 1 to 20 μm, the cleaning blade is a cleaning blade made of a polyurethane elastomer and having a peak value of at most 0.95, a peak temperature of −15 to 10° C. and a width at half maximum of at least 25° C. in viscoelasticity tan δ, the toner has a volume average particle diameter of 4 to 10 μm and an average circularity from 0.950 to 0.995, the charge level of the toner on the surface of the photosensitive member is 10 to 80 μC/g in terms of an absolute value, and the pH of a water extract of the toner is 3 to 8.

15 Claims, 2 Drawing Sheets

U.S. PATENT DOCUMENTS

| | | | | |
|---|---|---|---|---|
| 6,987,943 | B2 * | 1/2006 | Ito | 399/350 |
| 2002/0037990 | A1 * | 3/2002 | Hitoshi et al. | 528/80 |
| 2002/0142242 | A1 * | 10/2002 | Inoue et al. | 430/110.3 |
| 2002/0192430 | A1 | 12/2002 | Miura et al. | |
| 2003/0082470 | A1 * | 5/2003 | Asano et al. | 430/60 |
| 2005/0074685 | A1 * | 4/2005 | Kido et al. | 430/110.2 |
| 2005/0139701 | A1 * | 6/2005 | Naka et al. | 241/5 |
| 2006/0210311 | A1 * | 9/2006 | Kakui et al. | 399/159 |

FOREIGN PATENT DOCUMENTS

| | | | |
|---|---|---|---|
| JP | 01-217464 | | 8/1989 |
| JP | 2-284191 | A | 11/1990 |
| JP | 03-015858 | | 1/1991 |
| JP | 03-175456 | | 7/1991 |
| JP | 03-243954 | | 10/1991 |
| JP | 05-188637 | | 7/1993 |
| JP | 7-134526 | A | 5/1995 |
| JP | 08-146652 | | 6/1996 |
| JP | 11-015192 | | 1/1999 |
| JP | 2000-112315 | A | 4/2000 |
| JP | P3114020 | | 9/2000 |
| JP | 2001-255801 | | 9/2001 |
| JP | 2001255801 | A | 9/2001 |
| JP | 2002-296993 | | 10/2002 |
| JP | 2002-311634 | | 10/2002 |
| JP | 2002296993 | A | 10/2002 |
| JP | 2002-357921 | | 12/2002 |
| JP | 2003-012752 | | 1/2003 |
| JP | 2003012752 | A | 1/2003 |
| JP | 2003-186298 | | 7/2003 |
| JP | 2003-280274 | | 10/2003 |
| JP | 2003-280474 | | 10/2003 |
| JP | 2004-109716 | | 4/2004 |
| JP | 2004-117655 | | 4/2004 |
| JP | 2004-118161 | | 4/2004 |
| JP | 2004264359 | * | 9/2004 |
| JP | 2004317950 | * | 11/2004 |
| JP | 2004341327 | * | 12/2004 |
| JP | 2005121832 | * | 5/2005 |
| WO | WO 03/085459 | * | 10/2003 |
| WO | 2004072738 | * | 8/2004 |

OTHER PUBLICATIONS

Abstract of JP2004317950, Nov. 2004.*
Abstract of JP2004341327, Dec. 2004.*
Abstract of JP2005121832 May 2005.*
Publication family of US2006210311, Unknown date.*
Japanese Office Action dated Sep. 9, 2009 issued in corresponding Japanese patent Application No. 2006-514149.

* cited by examiner

IMAGE FORMING METHOD

TECHNICAL FIELD

The present invention relates to an image forming method making use of an electrophotographic system, and particularly to an image forming method, by which even when a toner containing spherical and small-sized colored resin particles and an external additive is used, the ability to clean off the toner remaining on the surface of a photosensitive member after transfer becomes excellent, and high-quality images can be stably formed under various environments. The image forming method according to the present invention is particularly suitable for a method for forming color images using color toners.

In the present invention, the toner means a developer comprising colored resin particles and an external additive. However, the toner may be called "a pulverized toner" where the colored resin particles, which are a main component of the toner, are obtained by a pulverization process or "a polymerized toner" where the colored resin particles are obtained by a polymerization process.

BACKGROUND ART

In an image forming process adopting an electrophotographic system, an image is generally formed through a charging step 1 of evenly and uniformly charging the surface of a photosensitive member (also referred to as "image-bearing member"); an exposure step 2 of exposing the charged surface of the photosensitive member to a patterned light (conducting optical writing) to form an electrostatic latent image; a development step 3 of developing the electrostatic latent image on the surface of the photosensitive member with a toner to form a toner image (visible image); a transfer step 4 of transferring the toner image on the surface of the photosensitive member to a transfer material; a fixing step 5 of fixing the toner image transferred to the transfer material by heat or pressure; and a cleaning step 6 of removing the toner remaining on the surface of the photosensitive member after the transfer step. In order to prevent the occurrence of a residual image, a static charge-eliminating step for the surface of the photosensitive member may also be provided between the cleaning step and the exposure step.

The photosensitive member is a member obtained by providing a photoconductive layer (photosensitive layer) on an electrically conductive base. In general, as the photosensitive member, is commonly used a function-separated type photosensitive drum obtained by arranging, as a photosensitive layer, a charge generation layer and a charge transport layer in this order on a cylindrical aluminum base (electrically conductive drum base). As the photosensitive member, various kinds of organic photoconductors such as a single-layer type and a reversed lamination type are known in addition to the function-separated type. As the forms of the photosensitive member, not only a drum form, but also other forms such as an endless belt form are known.

In the development step, is known a system, in which a developing roll is arranged in opposition to the surface of a photosensitive member, and an electrostatic latent image on the surface of the photosensitive member is developed in contact with a toner supplied on the developing roll to form a toner image. More specifically, in a developing device, the toner is supplied on the developing roll by a supply roll, the toner on the developing roll is formed into a thin layer by a layer thickness-regulating member, and the toner on the developing roll is brought into contact with the surface of the photosensitive member, on which the electrostatic latent image has been formed, to develop it, thereby forming the toner image. As the toner, is used a developer containing colored resin particles and an external additive.

As a cleaning method for removing the toner remaining on the surface of the photosensitive member after the toner image on the photosensitive member is transferred on a transfer material, is known a cleaning method by means of a cleaning blade. However, as will be described in detail subsequently, it has been found that a toner containing spherical and small-sized colored resin particles is poor in cleaning ability when the toner is applied to the cleaning method by means of the cleaning blade.

An image forming apparatus of the electrophotographic system, such as an electrophotographic copying machine or laser beam printer is required to form an image having high resolution at a high speed. In particular, with the development of high functionalization and formation of color images in recent years, the standard required for the formation of high-definition full-color images comes to be high. With the worldwide spread of image forming apparatus of the electrophotographic system, the image forming apparatus come to be used not only under a normal-temperature and normal-humidity environment, but also under wide environmental conditions from a high-temperature and high-humidity environment to a low-temperature and low-humidity environment. Therefore, there is a strong demand for development of an image forming method capable of forming high-quality images even under such wide environmental conditions.

In order to meet the above demand, various improvements are principally advanced from both points of image forming apparatus and toners. With respect to colored resin particles making up a toner, it is attempted to form particles having a smaller particle diameter and a sharper particle diameter distribution. In other words, the colored resin particles are desirably small in particle diameter and sharp in particle diameter distribution from the viewpoint of forming a high-definition and high-quality image. On the other hand, from the viewpoint of toner properties such as printing density, resolution, fog and cleaning ability, it is not preferable that fine colored resin particles considerably smaller than a predetermined average particle diameter exist in a great amount.

Toners are roughly divided into a pulverized toner with colored resin particles obtained by a pulverization process and a polymerized toner with colored resin particles obtained by a polymerization process. In the pulverization process, a thermoplastic resin is melted and kneaded together with additive components such as a colorant, a charge control agent and a parting agent, and the resultant kneaded product is pulverized and classified to obtain colored resin particles, thereby providing the pulverized toner. The pulverized toner is in an indefinable form, and its particle diameter distribution is broad. In the pulverized toner, a great amount of fine particles are produced by the pulverization. Since a thermoplastic resin having properties easy to be pulverized is used as a binder resin in the pulverized toner, the amount of fine particles formed by excessive pulverization increases when particles having a smaller particle diameter are formed. In order to make the particle diameter distribution of the pulverized toner sharp, a classification process is required. However, such a process is poor in yield because the amounts of coarse particles and fine particles removed by the classification increase in addition to a complicated process.

On the contrary, according to the polymerization process such as a suspension polymerization process, colored resin particles (also referred to as "colored polymer particles") having a desired average particle diameter and a sharp particle diameter distribution can be obtained. For example, in the suspension polymerization process, a polymerized toner is obtained as colored polymer particles by a process, in which a polymerizable monomer composition containing a polymerizable monomer, and various kinds of additive components such as a colorant and a charge control agent is dispersed as fine liquid droplets in an aqueous dispersion medium, and then polymerized.

According to the polymerization process, colored polymer particles having a spherical form and a sharp particle diameter distribution can be produced. According to the polymerization process, colored polymer particles (referred to as "core•shell type colored polymer particles") having a core•shell structure can also be obtained by additionally polymerizing a polymerizable monomer for shell in the presence of the colored polymer particles formed after the polymerization. When the glass transition temperature of a polymer component making up the core particles is made low, while the glass transition temperature of a polymer component making up the shell is made high, a polymerized toner excellent in both storage stability (blocking resistance) and low-temperature fixing ability can be produced.

According to the polymerization process, small-sized colored polymer particles having a volume average particle diameter of at most 10 μm, preferably 4 to 10 μm can be easily produced. Even when the polymerized toner is required to be classified for making its particle diameter distribution sharper, there is no need to remove a great amount of fine particles as compared with pulverized toner. Accordingly, the polymerized toner is permitted forming a high-definition image and also suitable for high-speed printing and formation of full-color images.

As described above, the polymerized toner having a small particle diameter bears an extremely important role in forming a high-resolution and high-definition image. However, various problems arise as the particle diameter of the polymerized toner is made smaller. One of such problems is the fact that such a polymerized toner is poor in cleaning ability.

It has been found that a toner containing spherical and small-sized colored resin particles is difficult to clean off the toner remaining on the surface of a photosensitive member after a transfer step, and an image formed tends to lower its image quality by the remaining toner. As a method for cleaning off the toner remaining on the surface of the photosensitive member, is known a method, in which an elastic cleaning blade made of an elastomer is brought into contact with the surface of the photosensitive member to remove the remaining toner. Since the spherical and small-sized colored resin particles (hereinafter may also be abbreviated as "spherical and small-sized toner") have high adhesiveness to the surface of the photosensitive member, however, a phenomenon that the toner passes through under the cleaning blade (between the cleaning blade and the photosensitive member) is easy to occur.

When a first color toner remains on the surface of the photosensitive member after a transfer step in the formation of an image using color toners, color mixing with color toners used on and after the second development occurs. Thus, a cleaning step for removing the remaining toner is more important than a case of the formation of a single-color image using a black toner. However, an organic pigment used as a colorant in the color toner is generally high in charging ability compared with carbon black used as a colorant in the black toner, so that its adhesiveness to the surface of the photosensitive member becomes great compared with the black toner.

Methods for improving the ability to clean off the remaining toner include a method, in which a charge level of the toner on the surface of the photosensitive member is lowered. According to such a method, however, the charging ability of the toner is further lowered upon long-term used under a high-temperature and high-humidity environment, so that the toner is easy to incur occurrence of fog and lowering of image density.

proposals have heretofore been made as to an image forming method of a cleanerless system (also referred to as "simultaneous developing and cleaning system") that cleaning is conducted simultaneously with development without using a cleaning blade, and developers using this image forming method [for example, Japanese Patent Application Laid-Open No. 5-188637 (U.S. Pat. No. 5,328,792)] and Japanese Patent Application Laid-Open No. 8-146652]. In the cleanerless system, a development means for developing an electrostatic latent image on the surface of a photosensitive member to form a toner image is combined with a cleaning means for recovering a toner remaining on the surface of the photosensitive member. When the cleanerless system is adopted for forming a full-color image with color toners, however, color mixing between respective colors becomes easy to occur by the recovery of the remaining toner.

For example, Japanese Patent Application Laid-Open No. 8-146652 discloses a color-image forming apparatus with a plurality of image forming units of the cleanerless system arranged in a row along a conveyer belt. In the color-image forming apparatus of such construction, color mixing by retransfer is easy to occur. The reason for it is that upon transfer of a toner image formed on and after development with the second color toner, a toner of another color, which has been already transferred on a transfer material, is caused to adhere to the surface of a photosensitive drum by adhesiveness between this toner and the photosensitive drum and repulsion force generated by polarity inversion of the toner by a transfer charger between the toner and the transfer material, and the toner adhered to the surface of the photosensitive drum is recovered within a developing device for another color toner than this toner upon simultaneous developing and cleaning.

In the image forming method meeting the formation of color images, a system that a toner remaining on the surface of a photosensitive member is cleaned off every color is preferred. Therefore, a cleaning system by means of a cleaning blade is reconsidered. In the image forming method including a cleaning step of removing the remaining toner by means of the cleaning blade, for example, an image forming method making use of a toner containing boron or phosphorus in a proportion of 0.1 to 100 ppm has been proposed (for example, Japanese Patent Application Laid-Open No. 2002-311634). There has also been proposed a method making use of a cleaning blade with fine particles caused to adhere in an adhesion quantity of 1 to 10 mg/cm$^2$ per unit area to the surface of at least a portion of the cleaning blade, with which an image-bearing member (photosensitive member) comes into contact (for example, Japanese Patent Application Laid-Open No. 2003-280474).

However, the above methods are not yet sufficient from the viewpoint of reducing the adhesiveness between the spherical and small-sized toner and the surface of the photosensitive member are insufficient in cleaning performance under a low-temperature and low-humidity environment in particular. In addition, the charge level of the toner is lowered when image formation is performed over a long period of time under a high-temperature and high-humidity environment, so that such a toner is easy to cause lowering of image density and fogging.

On the other hand, a cleaning blade made of a polyurethane elastomer has been proposed as a cleaning blade for small-sized toners (for example, Japanese Patent Application Laid-Open Nos. 2001-255801 and 2003-12752). However, the mere use of the cleaning blade made of the polyurethane elastomer is insufficient for cleaning off a spherical and small-sized toner under a low-temperature and low-humidity environment.

There has been proposed a method making use of color developers obtained by containing a flowability improver and spherical fine particles having a weight average particle diameter of 0.2 to 2.5 μm as external additives in colored resin particles upon formation of a color image by means of a latent image-bearing member (photosensitive member) composed of an organic photoconductor containing fluororesin powder (for example, Japanese Patent No. 3114020). When the fluororesin powder is contained in the organic photoconductor, however, the photosensitive member tends to lower the coefficient of friction thereof, so that the developability of a toner used may be lowered in some cases to easily create difficulty in obtaining an image having a high printing density.

DISCLOSURE OF THE INVENTION

It is an object of the present invention to provide an image forming method, by which even when a toner containing spherical and small-sized colored resin particles and an external additive is used, the toner remaining on the surface of a photosensitive member after a transfer step can be efficiently removed by using a cleaning blade, and high-definition and high-quality images can be formed even under low-temperature and low-humidity, and high-temperature and high-humidity environments, to say nothing of normal-temperature and normal-humidity environment.

The present inventors have carried out an extensive investigation with a view toward achieving the above object. As a result, it has been found that a developing method by developing an electrostatic latent image on the surface of a photosensitive member in contact with a toner supplied on a developing roll to form a toner image is adopted in an image forming process by an electrophotographic system, including a charging step, an exposure step, a development step, a transfer step, a fixing step and a cleaning step, and at this time, the surface characteristics of the developing roll are controlled and a cleaning blade made of a polyurethane elastomer having a specific viscoelasticity is used, whereby a remaining toner containing spherical and small-sized colored resin particles can be effectively removed even when a cleaning method making use of a cleaning blade is adopted, and a high-definition and high-quality image excellent in image characteristics such as printing density and durability can be formed under various environments. The fact that the surface of the developing roll is modified in addition to the improvement of the cleaning blade, whereby the cleaning ability is markedly improved, and the high-definition and high-quality image can be formed cannot be easily conceived even by a person skilled in the art.

On the other hand, even when the developing roll, the surface characteristics of which have been modified, and the cleaning blade made of the polyurethane elastomer having the specific viscoelasticity are used, the cleaning ability and/or the image quality may be lowered in some cases according to the properties of the spherical and small-sized toner used. The present inventors have thus carried out a further investigation. As a result, it has been found that the absolute value of a charge level of a spherical and small-sized toner on the surface of a photosensitive member is controlled within a specific range, and the pH of a water extract of the toner is controlled within a specific range, whereby the cleaning ability and image quality characteristics can be balanced with each other at a high level. The present invention has been led to completion on the basis of these findings.

According to the present invention, there is provided an image forming method comprising the following steps 1 to 6:

(1) a charging step 1 of charging the surface of a photosensitive member having a layer structure that a photosensitive layer is arranged on an electrically conductive base;

(2) an exposure step 2 of exposing the charged surface of the photosensitive member to a patterned light to form an electrostatic latent image;

(3) a development step 3 of developing the electrostatic latent image on the surface of the photosensitive member in contact with a toner supplied on a developing roll to form a toner image;

(4) a transfer step 4 of transferring the toner image on the surface of the photosensitive member to a transfer material;

(5) a fixing step 5 of fixing the toner image transferred to the transfer material; and (6) a cleaning step 6 of removing the toner remaining on the surface of the photosensitive member after the transfer step by means of a cleaning blade brought into contact with the surface of the photosensitive member, wherein (a) the developing roll has a surface brightness from 30 to 220 and a surface roughness Rz from 1 to 20 μm, (b) the cleaning blade is a cleaning blade made of a polyurethane elastomer and has a peak value of viscoelasticity tan δ of at most 0.95, a peak temperature of viscoelasticity tan δ from −15 to 10° C. and a width at half maximum of viscoelasticity tan δ of at least 25° C., (c) the toner contains colored resin particles having a volume average particle diameter from 4 to 10 μm and an average circularity from 0.950 to 0.995 and an external additive, (d) the charge level of the toner on the surface of the photosensitive member is 10 to 80 μC/g in terms of an absolute value, and (e) the toner shows a pH of 3 to 8 as measured in the form of an extract obtained by a boiling treatment in ion-exchanged water having a pH of 7.

BEST MODE FOR CARRYING OUT THE INVENTION

The image forming method according to the present invention comprises (1) a charging step 1 of evenly and uniformly charging the surface of a photosensitive member; (2) an exposure step 2 of exposing the charged surface of the photosensitive member to a patterned light to form an electrostatic latent image; (3) a development step 3 of developing the electrostatic latent image on the surface of the photosensitive member in contact with a toner supplied on a developing roll to form a toner image; (4) a transfer step 4 of transferring the toner image on the surface of the photosensitive member to a transfer material; (5) a fixing step 5 of fixing the toner image transferred to the transfer material; and (6) a cleaning step 6 of removing the toner remaining on the surface of the photosensitive member after the transfer step by means of a cleaning blade brought into contact with the surface of the photosensitive member. In addition to these steps, other steps such as a static charge-eliminating step may be additionally arranged.

Figure 1:
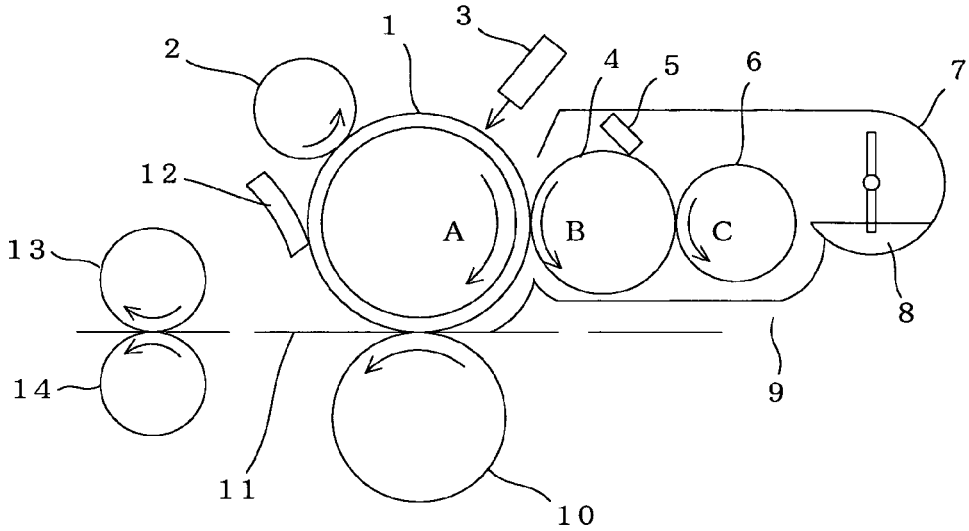
FIG. 1 illustrates an exemplary image forming apparatus to which the image forming method according to the present invention is applied.

The image forming method adopted in the present invention will be described with reference to FIG. 1. FIG. 1 illustrates an exemplary image forming apparatus to which the image forming method adopted in the present invention can be applied. As illustrated in FIG. 1, a photosensitive drum 1 as a photosensitive member is installed rotatably in a direction of an arrow A in the image forming apparatus. The photosensitive member is obtained by forming a photosensitive layer on an electrically conductive base. The photosensitive drum 1 is obtained by providing a photosensitive layer on an electrically conductive drum base. The photosensitive layer is composed of, for example, an organic photoconductor, selenium photoconductor, zinc oxide photoconductor, amorphous silicon photoconductor or the like. Among these, the organic photoconductor (OPC) is preferred.

A function-separated type photoconductor obtained by forming a charge generation layer containing at least a charge-generating agent on an electrically conductive base and forming a charge transport layer containing at least a charge-transporting agent thereon is representative of the organic photoconductors. In this case, the photosensitive layer is formed by the charge generation layer and the charge transport layer. With respect to the electrically conductive base, aluminum alloys such as JIS 3000 series, JIS 5000 series or JIS 6000 series in JIS (Japanese Industrial Standards) are preferably used as a material. The form thereof is preferably a drum form, and the diameter thereof is generally 20 to 60 mm, preferably 24 to 40 mm.

A sublayer composed of an alumite layer subjected to an anodic oxidation treatment or an undercoating layer using a resin material is preferably provided on the electrically conductive base. The thickness of the alumite layer is generally 5 to 50 μm, preferably 5 to 20 μm, more preferably 5 to 10 μm. The film thickness of the undercoating layer using the resin material is generally 5 to 50 μm, preferably 5 to 30 μm, more preferably 10 to 30 μm.

As the charge-generating agent contained in the charge generation layer, is preferably used a dis-azo pigment or oxytitanium phthalocyanine. The film thickness of the charge generation layer is generally 0.01 to 5.0 μm, preferably 0.1 to 1.0 μm, more preferably 0.2 to 0.5 μm.

As the charge-transporting agent contained in the charge transport layer, is preferably used a stilbene or butadiene compound. The film thickness of the charge transport layer is generally 5 to 50 μm, preferably 10 to 30 μm.

A charging roll 2 as a charging member, a laser beam irradiation device 3 as a light exposer, a developing device 9, a transfer roll 10 and a cleaning blade 12 are arranged around the photosensitive drum 1 along a peripheral direction thereof. The charging step is a step of evenly and positively or negatively charging the surface of the photosensitive drum 1 by the charging member. Charging systems by the charging member include a contact charging system that charging is conducted by a fur brush, magnetic brush, blade or the like in addition to the charging roll 2 illustrated in FIG. 1, and a non-contact charging system by corona discharge, and the charging roll 2 may be replaced by these.

The exposure step is a step of irradiating the surface of the photosensitive drum 1 with light corresponding to an image signal by the laser beam irradiation device 3 illustrated in FIG. 1 to expose the surface to the a patterned light, thereby forming an electrostatic latent image on the evenly charged surface of the photosensitive drum 1. The laser beam irradiation device 3 is constructed by, for example, a laser irradiation unit and an optical lens system. Besides the laser beam irradiation device 3, for example, an LED irradiation device may be mentioned as the light exposer.

The development step is a step of applying a toner (developer) to the electrostatic latent image formed on the surface of the photosensitive drum 1 by the developing device 9. The charging polarity of the developer is selected in such a manner that the toner is applied only to a portion irradiated with the light in reversal development, or the toner is applied only to a portion irradiated with no light in normal development.

The developing device 9 illustrated in FIG. 1 is a developing device used in a one-component contact-developing system using a one-component developer (toner). In a casing 7, in which a toner 8 is stored, a developing roll 4 and a supply roll 6 are arranged. The developing roll 4 is arranged in opposition to the photosensitive drum 1 in such a manner that a part thereof comes into contact with the photosensitive drum 1, and is rotated in a direction B opposite to the rotating direction of the photosensitive drum 1. The supply roll 6 is rotated in contact with and in the same direction C as the developing roll 4 to supply the toner 8 to the outer periphery (surface) of the developing roll 4.

A blade 5 for developing roll as a toner layer thickness-regulating member is arranged at a position between the contact point with the supply roll 6 and the contact point with the photosensitive drum 1 on the periphery of the developing roll 4. This blade 5 is composed of, for example, a conductive rubber elastic substance or metal. A thin layer of the toner is formed on the surface of the developing roll 4 by the toner layer thickness-regulating member. The thin layer of the toner on the developing roll 4 comes into contact with the surface of the photosensitive drum to develop the electrostatic latent image on the surface of the photosensitive drum into a toner image (visible image).

The transfer step is a step of transferring the toner image formed on the surface of the photosensitive drum 1 in the development step to a transfer material 11 such as paper. In the transfer step, the transfer is generally conducted by means of such a transfer roll 10 as illustrated in FIG. 1. Besides the above, there are belt transfer and corona transfer. The cleaning step is a step of cleaning off the toner remaining on the surface of the photosensitive drum 1. In the cleaning step, such a cleaning blade 12 as illustrated in FIG. 1 is generally used. Even in the present invention, the cleaning blade 12 is used to conduct cleaning. After the transfer step, the transfer material 11 having the toner image is transferred to the fixing step. In the fixing step, the transfer material is passed through between, for example, a heating roll 13 and a pressure roll 14 to fix the toner image to the transfer material by heating and pressurization.

In the image forming apparatus illustrated in FIG. 1, the whole surface of the photosensitive drum 1 is evenly charged negatively by the charging roll 2, and an electrostatic latent image is then formed by the laser beam irradiation device 3 and further developed by the developing device 9 to form a toner image. The toner image on the photosensitive drum 1 is transferred to a transfer material such as paper by the transfer roll 10, and the toner (remaining toner after transfer) remaining on the surface of the photosensitive drum 1 is cleaned off by the cleaning blade 12. After the cleaning step, the next image forming cycle is started.

Figure 2:
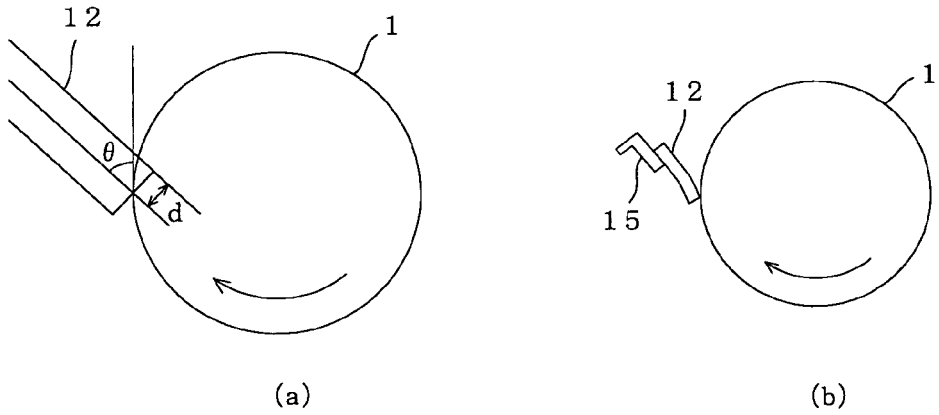
FIG. 2 typically illustrates, on an enlarged scale, a photosensitive drum and a cleaning blade, wherein FIG. 2(*a*) is an explanatory drawing illustrating a case where the tip of the cleaning blade is supposed to penetrate into the photosensitive drum without being deformed as it is, and FIG. 2(*b*) is an explanatory drawing illustrating a contact state of the cleaning blade with the surface of the photosensitive drum.

FIG. 2 typically illustrates, on an enlarged scale, the photosensitive drum 1 and the cleaning blade 12. The cleaning blade 12 used in the image forming apparatus illustrated in FIG. 1 comes into contact with the surface of the photosensitive drum 1 from a direction (i.e., a counter direction) opposite to the rotating direction of the drum as illustrated in FIG. 2(*b*). The cleaning blade 12 is fixed to the interior of the apparatus by a supporting member 15. The cleaning blade 12 is brought into contact with the surface of the photosensitive drum at a predetermined penetration d and a prescribed set angle θ. Here, the penetration d means a penetration in a perpendicular direction to an axis of the cleaning blade when the tip of the cleaning blade 12 is supposed to penetrate into the photosensitive drum 1 without being deformed as it is as illustrated in FIG. 2(*a*). The set angle θ of the cleaning blade means an angle formed by a tangential line at a point where the tip surface of the cleaning blade 12 intersects with the photosensitive drum 1 and the axis of the cleaning blade 12.

The penetration d is generally 0.7 to 1.5 mm, preferably 0.9 to 1.5 mm. When the penetration d falls within this range, the cleaning blade 12 is inhibited from being turned up by the rotation of the photosensitive drum, and so the cleaning ability is improved. The set angle θ is generally 10 to 30°, preferably 15 to 30°. When this set angle θ falls within this range, the cleaning blade 12 is inhibited from being turned up by the rotation of the photosensitive drum, and so the cleaning ability is improved.

The thickness of the tip portion of the cleaning blade 12 is generally 1.0 to 2.5 mm, preferably 1.2 to 2.3 mm, more preferably 1.4 to 2.1 mm. When the thickness of the tip portion of the cleaning blade 12 falls within this range, the abrasion of the surface of the photosensitive drum and the phenomenon that the cleaning blade is turned up are inhibited. The hardness (spring type hardness A-type in accordance with JIS K 6253); also referred to as "JIS A hardness") of the cleaning blade is generally 60 to 90, preferably 65 to 80, more preferably 68 to 75. When the hardness of the cleaning blade falls within this range, the abrasion of the surface of the photosensitive drum and the phenomenon that the cleaning blade is turned up are inhibited.

The image forming apparatus illustrated in FIG. 1 is that used for forming a monochromatic image. However, the image forming method according to the present invention may also be applied to color-image forming apparatus such as copying machines and printers for forming color images. The color-image forming apparatus include a multiple development system that a latent image is developed into a multicolor toner image on a photosensitive member, and this multicolor toner image is transferred to a transfer material collectively; and a multiple transfer system that a process comprising developing a latent image into only a single-color toner image on a photosensitive member and then transferring the toner image to a transfer material is conducted repeatedly by times corresponding to the number of color toners. The multiple transfer system includes a transfer drum system that a transfer material is wound on a transfer drum to conduct transfer every color; an intermediate transfer system that primary transfer to an intermediate transfer medium is conducted every color to form a multi-color image on the intermediate transfer medium, and secondary transfer is then conducted collectively; and a tandem system that photosensitive member units (other parts than a fixing device, including a developing device) of respective colors are arranged tandem, and a transfer material is sucked and conveyed by a transfer conveyer belt to successively transfer images of the respective colors to the transfer material. Among these transfer systems, the tandem system is preferred in that an image forming speed can be accelerated.

A first feature of the image forming method according to the present invention resides in that a developing roll, whose surface brightness and surface roughness Rz have been controlled within ranges of 30 to 220 and 1 to 20 μm respectively, is used as the developing roll in such an image forming process of the electrophotographic system as described above.

Figure 3:
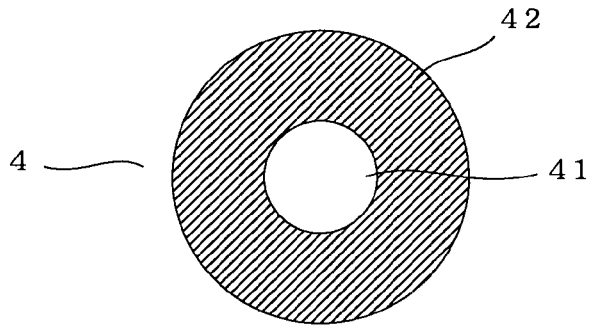
FIG. 3 is a cross-sectional view of a developing roll.

A production process of the developing roll will hereinafter be described. As illustrated in FIG. 3, the developing roll is equipped with a columnar electrically-conductive shaft 41 and a cylindrical elastic layer 42 covering the surface of this electrically-conductive shaft 41. The surface brightness and surface roughness Rz of the developing roll are controlled within ranges of 30 to 220 and 1 to 20 μm respectively.

No limitation is imposed on the material of the electrically-conductive shaft 41. However, examples of the shaft used include metallic cores composed of iron, aluminum, SUS (stainless steel) or brass; shafts obtained by plating the surface of a core composed of a thermoplastic resin or thermosetting resin with a metal film; shafts obtained by vapor-depositing a metal film on the surface of a core composed of a thermoplastic resin or thermosetting resin; and cores formed by a resin composition with carbon black, metal powder or the like as an electrical conductivity-imparting agent incorporated into a thermoplastic resin or thermosetting resin.

The elastic layer 42 is composed of rubber (elastomer) such as silicone rubber, ethylene-propylene-diene rubber, polyurethane, chloroprene rubber, natural rubber, butyl rubber, polyisoprene rubber, polybutadiene rubber, styrene-butadiene rubber, nitrile rubber, ethylene-propylene rubber, acrylic rubber or a mixture thereof.

Into any of these rubbers, are incorporated a filler such as fumed silica, precipitated silica or reinforcing carbon black; electrically conductive carbon black; metal powder such as nickel, aluminum or copper powder; a metal oxide such as zinc oxide or tin oxide; an electrically conductive filler obtained by coating a core material such as barium sulfate, titanium oxide or potassium titanate with tin oxide; and/or the like, and the resultant mixture is kneaded together with a vulcanizing agent such as hydrogen siloxane or isocyanate in the presence of a platinum catalyst. A product obtained in such a manner is used.

The elastic layer may remain intact on the surface of the developing roll. However, a surface layer may also be provided on the elastic layer. No particular limitation is imposed on a material for forming the surface layer, and examples thereof include alkyd resins, alkyd resins modified by phenol, silicone or the like, oil-free alkyd resins, acrylic resins, silicone resins, epoxy resins, fluororesins, phenol resins, polyamide resins, urethane resins and mixtures thereof. In order to provide the surface layer with any of these resins on the elastic layer, a method of coating with the resin is adopted. The developing roll used in the invention of the present application is preferably that obtained by coating the elastic layer provided on the electrically conductive shaft with the resin.

The surface brightness of the developing roll is controlled within a range from 30 to 220. The surface brightness of the developing roll is preferably 50 to 200, more preferably 60 to 140. If the surface brightness of the developing roll is too low, an image density becomes higher than the image needs upon black solid printing, and density unevenness occurs upon half tone printing to lower dot reproducibility. If the surface brightness of the developing roll is too high, an image density becomes low upon black solid printing, and paper that is a printing medium is seen through, resulting in difficulty in providing a good image. If the surface brightness of the developing roll is too high, dot reproducibility is also lowered upon half tone printing. The surface brightness of the developing roll is controlled within the above range, whereby a good image can be provided. The surface brightness of the developing roll is a value determined by a surface brightness value measuring apparatus illustrated in FIG. 4, and a specific measuring method will be described in EXAMPLES.

The surface roughness Rz (ten points average roughness Rz) of the developing roll is 1 to 20 μm, preferably 3 to 10 μm, more preferably 3 to 8 μm. If the surface roughness Rz of the developing roll is too low, an image density becomes low. If the surface roughness Rz of the developing roll is too high, an image density becomes too high, fog is also easy to occur, and resolution is also lowered. The surface roughness Rz of the developing roll is a value measured in accordance with a measuring method described in EXAMPLES.

The surface brightness and surface roughness Rz of the developing roll are controlled within the above respective ranges, whereby the cleaning ability by means of the cleaning blade is markedly improved, and high-definition and high-quality image can be formed under various environments. In order to control the surface brightness and surface roughness Rz of the developing roll within the above respective ranges, methods of selecting the kinds of a rubber material forming the elastic layer and additive components, of controlling a method for forming the elastic layer and of forming the surface layer (resin-coated surface) are mentioned.

An electric resistance between the metal core of the developing roll and the surface of the developing roll is within a range of generally $10^5$ to $10^9\Omega$, preferably $10^6$ to $10^8\Omega$. If this electric resistance is too lower than the above range, a developing bias is over-applied to easily cause fog. If this electric resistance is too high, no developing bias is applied, and so developability is deteriorated to lower an image density.

A second feature of the image forming method according to the present invention resides in that a cleaning blade made of a polyurethane elastomer and having a peak value of viscoelasticity tan δ of at most 0.95, a peak temperature of viscoelasticity tan δ from −15 to 10° C. and a width at half maximum of viscoelasticity tan δ of at least 25° C. is used as the cleaning blade in such an image forming process of the electrophotographic system as described above.

The viscoelastic properties may be measured by using a viscoelastometer (for example, trade name "DVE-V4" manufactured by Rheology Co.) and heating a sample at a measuring frequency of 10 Hz and a heating rate of 2.5° C./min from a low temperature side. The details of the measuring method are as described in EXAMPLES.

The peak value (viscoelasticity peak value) of viscoelasticity tan δ is preferably at most 0.90, more preferably within a range of 0.70 to 0.90. The peak temperature of viscoelasticity tan δ is preferably −10 to 10° C. The width at half maximum of viscoelasticity tan δ is preferably within a range of 25 to 35° C.

The hardness ("JIS A hardness" which will be described subsequently) of the cleaning blade is generally 60 to 90, preferably 65 to 80, more preferably 68 to 75. If the hardness of the cleaning blade is too high, the photosensitive member is easy to be abraded. If the hardness is too low, such a cleaning blade is easy to be turned up by the photosensitive member upon cleaning.

The polyurethane elastomer making up the cleaning blade according to the present invention is preferably that synthesized by using a polyester polyol, a diisocyanate compound, a chain-lengthening agent and a crosslinking agent.

As the polyester polyol are preferred condensed polyesters obtained by polycondensing at least one of dicarboxylic acids such as succinic acid, glutaric acid, adipic acid, sebacic acid, azelaic acid and maleic acid with at least one of glycols such as ethylene glycol (EG), 1,3-propylene glycol, 1,4-butanediol (BD), 1,6-hexanediol, neopentyl glycol (NPG), 3-methyl-1,5-pentanediol, 2,4-diethyl-1,5-pentanediol, 1,8-octanediol, 1,10-decanediol and diethylene glycol; and ring-opening polymerization polyesters obtained by subjecting any of the above-described glycols to ring-opening addition polymerization with a lactone such as ∈-caprolactone or valerolactone.

Among the polyester polyols, polyester polyols containing, as a constitutive component, a side chain-containing glycol such as neopentyl glycol, 3-methyl-1,5-pentanediol or 2,4-diethyl-1,5-pentanediol are preferred, with polyester polyols containing neopentyl glycol (NPG) as a constitutive component being particularly preferred. A difunctional polyester polyol having an average molecular weight of 800 to 3,000 as measured by an end-group determination method is preferably used as the polyester polyol. Polyester polyols different in average molecular weight may also be used in combination, or at least two polyester polyols different in composition may also be used.

Among the polyester polyol compounds, the lactone type polyester polyol obtained by subjecting ∈-caprolactone or valerolactone to ring-opening polymerization is particularly preferably used because a cleaning blade having excellent abrasion resistance can be obtained.

When the polyester polyol type polyurethane elastomer is synthesized by using a polyester polyol containing neopentyl glycol as a constitutive component, such viscoelastic properties as described above can be easily imparted. The content of the side chain-containing glycol such as neopentyl glycol (NPG) in the polyester polyol is preferably 1 to 10% by weight, more preferably 2 to 8% by weight, particularly preferably 2 to 5% by weight based on the total weight of the polyester polyol. The lactone type polyester polyol containing neopentyl glycol as a constitutive component is preferably used as the polyester polyol because the resulting cleaning blade exhibits excellent cleaning performance under wide environments from a low-temperature and low-humidity environment to a high-temperature and high-humidity environment.

As examples of the diisocyanate compound, may be mentioned aromatic diisocyanate compounds such as 4,4'-diphenylmethane diisocyanate (MDI), 2,4-toluene diisocyanate (2,4-TDI), 2,6-toluene diisocyanate, naphthalene diisocyanate and 4,4'-diphenylene diisocyanate; aliphatic diisocyanate compounds such as ethylene diisocyanate, 2,2,4-trimethylhexamethylene diisocyanate and 1,6-hexamethylene diisocyanate (HDI); and alicyclic diisocyanate compounds such as hydrogenated 4,4'-diphenylmethane diisocyanate (HMDI), 1,4-cyclohexane diisocyanate (CHDI), methylcyclohexylene diisocyanate, isophorone diisocyanate (IPDI), hydrogenated m-xylylene diisocyanate (HXDI) and norbornane diisocyanate. These diisocyanate compounds may be used either singly or in any combination thereof. Among these diisocyanate compounds, 4,4'-diphenylmethane diisocyanate is preferred.

As the chain-lengthening agent, may be used a glycol. Specific examples thereof include ethylene glycol, propylene glycol, 1,4-butanediol and neopentyl glycol. At least one of ethylene glycol and 1,4-butanediol is preferably used as the chain-lengthening agent.

As the crosslinking agent, may be used a trifunctional or still higher functional polyhydric alcohol. Specific examples thereof include trimethylolpropane, triethylolpropane, pentaerythritol and triethanolamine. The crosslinking agents may be used either singly or in any combination thereof. Among these, trimethylolpropane is preferred.

A polymerization catalyst for polyurethane may be used in the synthesis of the polyurethane elastomer. Examples of the polymerization catalyst include organotin catalysts such as dibutyltin dilaurate and tin octylate; tertiary amine catalysts such as triethylenediamine, N-methylmorpholine, N,N,N',N'-tetramethylethylenediamine, N,N,N',N'-tetramethylhexamethylenediamine 1,8-diazabicyclo-[5.4.0]undecene (DBU), bis(N,N-dimethylamino-2-ethyl) ether and bis(2-dimethylaminoethyl) ether; carboxylic acid metal salt catalysts such as potassium acetate and potassium octylate; and imidazole catalysts. Among these, the tertiary amine catalysts are preferred.

The cleaning blade can be produced in accordance with a publicly known process. For example, the cleaning blade can be produced in accordance with a production process comprising a prepolymer preparing step of reacting a polyol compound with a diisocyanate compound to prepare an isocyanate prepolymer or pseudo-isocyanate prepolymer; a mixing step of mixing the isocyanate prepolymer or pseudo-isocyanate prepolymer with component including a crosslinking agent and a chain-lengthening agent to prepare a reactive composition; a molding step of molding the reactive composition into a molded product having a predetermined form by means of a mold or the like; and a cutting step of cutting the molded product into a predetermined blade size when the molded product is in the form of a sheet.

In the prepolymer preparing step, the prepolymer is prepared by a complete prepolymer process, in which the whole amount of the polyol compound is reacted with the diisocyanate compound to prepare the isocyanate prepolymer, or a pseudo-prepolymer process making use of a part of the polyol compound as a mixture with the crosslinking agent and the chain-lengthening agent so far as the prepolymer has the same composition.

The cleaning blade formed from the sheet of the polyurethane elastomer is generally fixed to the supporting member (for example, fitting) 15 with an adhesive or the like as illustrated in FIG. 2(*b*) and installed as a cleaning unit in the image forming apparatus.

The cleaning blade made of the polyurethane elastomer may be used without subjecting it to a surface treatment. However, a surface treatment such as application of fine particles may be performed as needed. Specifically, the application of fine particles to the surface of at least a portion of the cleaning blade, with which the photosensitive member (image-bearing member) comes into contact is preferred in that cleaning ability is improved. Specific examples of a process for applying the fine particles include a process, in which fine particles are dispersed in any of various kinds of organic solvents, surfactants, acrylic emulsions or acrylic dispersions to prepare a dispersion liquid, and the dispersion liquid is applied to a predetermined portion of the cleaning blade and dried.

Examples of the fine particles applied to the surface of the cleaning blade include organic fine particles composed of a synthetic resin such as a polyolefin resin, fluororesin, polyester resin, acrylic resin or aromatic vinyl resin; inorganic fine particles composed of calcium oxide, calcium phosphate, silica, molybdenum sulfide or the like; and colored resin particles for toners. The spherical colored resin particles used in the present invention may be used as the fine particles.

The average particle diameter of the fine particles is generally at least 0.1 μm, preferably 0.1 to 20 μm, more preferably 0.3 to 15 μm, particularly preferably 0.5 to 10 μm. The average particle diameter of the fine particles can be determined by placing the fine particles in water, dispersing them with a neutral detergent and subjecting the resultant dispersion liquid to measurement by means of a laser type particle size distribution measuring machine (manufactured by Nikkiso Co., Ltd., trade name "Microtrack FRA"). The form of the fine particles may be in a non-spherical form such as an indefinable form, cube, rectangular parallelopiped or polyhedron, or in a spherical form.

In order to apply the fine particles to the cleaning blade, a process, in which a portion to be applied is coated with a nonionic surfactant, and fine particles are applied in a coating weight within a range of 1 to 10 mg/cm$^2$ per unit area to the coated surface, and then dried at a temperature of generally 30 to 90° C., preferably 35 to 60° C., is preferably adopted.

A third feature of the image forming method according to the present invention resides in that a specific toner is used in such an image forming process of the electrophotographic system as described above, and the charge level of the toner on the surface of the photosensitive member is controlled within a range of 10 to 80 μC/g in terms of an absolute value |Q|.

The toner used in the image forming method according to the present invention is a developer containing colored resin particles and an external additive. The toner used in the present invention is preferably a one-component developer, more preferably a non-magnetic one-component developer.

The volume average particle diameter dv of the colored resin particles that are a main component of the toner is 4 to 10 μm, preferably 4 to 9 μm, more preferably 5 to 8 μm. The volume average particle diameter is a value measured in accordance with a method described in EXAMPLES. When the volume average particle diameter dv of the colored resin particles falls within the above range, a toner, which is high in flowability, good in transferability and free of occurrence of blur and can provide images high in printing density and resolution, can be obtained.

In a particle diameter distribution of the colored resin particles, a proportion of colored resin particles having a particle diameter not greater than 3 μm is preferably at most 20% by number, more preferably at most 10% by number, particularly preferably at most 5% by number. The proportion of the colored resin particles having a particle diameter not greater than 3 μm preferably falls within the above range because the cleaning ability of the resulting toner is improved.

The particle diameter distribution represented by a ratio dv/dp of the volume average particle diameter dv to the number average particle diameter dp of the colored resin particles is preferably 1.0 to 1.3, more preferably 1.0 to 1.2. When the particle diameter distribution dv/dp of the colored resin particles falls within the above range, a toner, which is free of occurrence of blur and good in transferability and can provide images high in printing density and resolution, can be obtained. The volume average particle diameter and number average particle diameter of the colored resin particles can be measured by means of, for example, a Multisizer (manufactured by Beckmann Coulter Co.).

The average circularity of the colored resin particles is 0.950 to 0.995, preferably 0.960 to 0.995, more preferably 0.970 to 0.990. When the average circularity of the colored resin particles falls within the above range, the fine line reproducibility of the resulting toner upon printing can be improved.

The circularity of the colored resin particles is defined as a ratio of a peripheral length of a circle having the same projected area as a particle image to a peripheral length of a projected image of such a particle. The average circularity is a method for quantitatively representing the form of particles and an index indicating the degree of irregularities of the colored resin particles. The average circularity indicates 1 where the colored resin particles are in the form of a complete sphere, and becomes a smaller value as the surface form of the colored resin particles becomes more irregular. The average circularity (Ca) is a value determined by the following equation (1).

$$\text{Average circularity} = \left(\sum_{i=1}^{n} (Ci \times fi)\right) \Big/ \sum_{i=1} (fi) \tag{1}$$

In the formula (1), n is the number of particles of which the circularity Ci is determined. The circularity Ci is a circularity of each particle calculated out by the following equation (2) on the basis of a peripheral length measured as to each particle in a group of particles corresponding to circles having a diameter of 0.6 to 400 μm.

$$Ci = (\text{Peripheral length of a circle equal to the projected area of a particle})/(\text{Peripheral length of the projected area of the particle}) \tag{2}$$

In the equation (1), fi is a frequency of the particle having a circularity Ci. The circularity and average circularity can be measured by means of, for example, a Flow Particle Image Analyzer, trade name "FPIA-2100" or trade name "FPIA-2000" (manufactured by SYSMEX CORPORATION).

In the present invention, image formation is performed by controlling the absolute value |Q| of the charge level of the toner on the surface of the photosensitive member so as to fall within a range of 10 to 80 μC/g, preferably 15 to 55 μC/g. The absolute value of the charge level was measured by a method, in which solid printing is conducted under a normal-temperature and normal-humidity (N/N) environment of 23° C. in temperature and 50% in humidity, and the toner used in development on the photosensitive member is sucked by a suction type charge level meter (manufactured by TREK JAPAN K.K., model name "210HS-2A") to calculate out a charge level Q (μC/g) per unit weight of the toner on the basis of the weight of the toner sucked and a measured value (μC). Since toners include a positively charged toner and a negatively charged toner, the charge level per unit weight of the toner is represented by the absolute value |Q| of the positive or negative charge level. The details of the measuring method as to the absolute value of the charge level are as described in EXAMPLES.

The absolute value of the charge level of the toner on the surface of the photosensitive member falls within the above range, whereby cleaning ability and image quality can be balanced with each other at a high level. If the absolute value of the charge level of the toner on the surface of the photosensitive member is too great, cleaning ability of the toner upon printing under a high-temperature and high-humidity environment is lowered, and fog is also easy to occur. If the absolute value of the charge level of the toner on the surface of the photosensitive member is too small, the cleaning ability becomes relatively good, but a printing density upon printing under a high-temperature and high-humidity environment is lowered, and fog is also easy to occur.

The absolute value of the charge level of the toner on the surface of the photosensitive member can be controlled within the above range by adjusting the kind and amount of a charge control agent contained in the colored resin particles, which will be described subsequently, the kind and amount of an external additive, the construction of the photosensitive member, the construction of the developing roll, a bias voltage between the photosensitive member and the developing roll, and the like.

A development rate M/A (amount of the toner on the photosensitive member after development) of the toner on the surface of the photosensitive member is preferably within a range from 0.3 to 0.8 mg/cm$^2$. This development rate is a value measured by a measuring method described in EXAMPLES. More specifically, the toner used in development on the photosensitive member is sucked by the suction type charge level meter. A filter, the weight of which has been precisely measured in advance, is fitted into a Faraday gage of this charge level meter, a filter area A (cm$^2$) of a sucked portion after the suction was measured, and the development rate M/A (mg/cm$^2$) is calculated out from this measured value A and an increment [i.e., amount M (mg) of the toner sucked] in weight of the Faraday gage. If the amount (development rate) of the toner on the photosensitive member after the development is too small, the resulting image shows a tendency to lower its printing density. The development rate falls within the above range, whereby the printing density can be controlled within a proper range.

The toner containing the colored resin particles and the external additive shows a pH of 3 to 8 as measured in the form of an extract obtained by a boiling treatment in ion-exchanged water having a pH of 7. The pH is a value measured by a method described in EXAMPLES. This pH is preferably 4 to 8, particularly preferably 5 to 7. The pH is controlled within the above range, whereby the toner can be provided as a toner excellent in printing density under various environments.

The colored resin particles making up the toner have a volume resistivity of generally 11.0 to 12.0 [log(Ω·cm)], preferably 11.2 to 11.8 [log(Ω·cm)] as measured by means of a dielectric loss measuring device. If the volume resistivity is too low, fog may occur in some cases. If the volume resistivity is too high, cleaning failure may occur in some cases. The colored resin particles have a softening temperature of generally 50 to 80° C., preferably 60 to 70° C. and an incipient fluidization temperature of generally 90 to 150° C., preferably 100 to 130° C. as measured by means of a flow tester. If the softening temperature is too low, the storage stability of the resulting toner may be deteriorated in some cases. If the softening temperature is too high, the fixing ability of the resulting toner may be deteriorated in some cases. The glass transition temperature of the colored resin particles as measured by a differential scanning calorimeter (DSC) is generally 0 to 80° C., preferably 40 to 60° C. If the glass transition temperature is too low, the storage stability of the resulting toner may be deteriorated in some cases. If the glass transition temperature is too high, the fixing ability of the resulting toner may be deteriorated in some cases.

The colored resin particles making up the toner used in the present invention are colored resin particles containing at least a binder resin and a colorant. The colored resin particles preferably contain a parting agent and a charge control agent in addition to the colorant. As specific examples of the binder resin, may be mentioned binder resins widely used in the technical field of toners heretofore, such as polystyrene and styrene-alkyl (meth)acrylate copolymers.

As the colorant, may be used all colorants and dyes such as carbon black, titanium black, magnetic powders, oil black and titanium white. As the carbon black, is preferably used that having a primary particle diameter of 20 to 40 nm, since when the particle diameter falls within this range, such carbon black can be evenly dispersed in the resulting toner, and fog is also lessened. When full-color toners (generally composed of a yellow toner, a magenta toner and a cyan toner) are provided, a yellow colorant, a magenta colorant and a cyan colorant are generally used respectively.

As the yellow colorant, may be used, for example, compounds such as azo colorants and fused polycyclic colorants. Specific examples thereof include C.I. Pigment Yellow 3, 12, 13, 14, 15, 17, 62, 65, 73, 74, 83, 90, 93, 97, 120, 138, 155, 180, 181, 185 and 186.

As the magenta colorant, may be used, for example, compounds such as azo colorants and fused polycyclic colorants. Specific examples thereof include C.I. Pigment Red 31, 48, 57, 58, 60, 63, 64, 68, 81, 83, 87, 88, 89, 90, 112, 114, 122, 123, 144, 146, 149, 150, 163, 170, 184, 185, 187, 202, 206, 207, 209 and 251; and C.I. Pigment Violet 19.

As the cyan colorant, may be used, for example, copper phthalocyanine compounds and derivatives thereof, and anthraquinone compounds. Specific examples thereof include C.I. Pigment Blue 2, 3, 6, 15, 15:1, 15:2, 15:3, 15:4, 16, 17 and 60. The amount of each colorant used is preferably 1 to 10 parts by weight per 100 parts by weight of the binder resin.

Examples of the parting agent include polyolefin waxes such as low-molecular weight polyethylene, low-molecular weight polypropylene and low-molecular weight polybutylene; vegetable natural waxes such as candelilla wax, carnauba wax, rice wax, Japan wax and jojoba wax; petroleum waxes such as paraffin wax, microcrystalline wax and petrolatum wax, and modified waxes thereof; synthetic waxes such as Fischer-Tropsch wax; and polyfunctional ester compounds such as pentaerythritol tetrastearate, pentaerythritol tetrapalmitate and dipentaerythritol hexamyristate.

These parting agents may be used either singly or in any combination thereof. Among the parting agents, the synthetic waxes and polyfunctional ester compounds are preferred. Among these parting agents, polyfunctional ester compounds, whose endothermic peak temperatures fall within a range of preferably 30 to 150° C., more preferably 40 to 100° C., still more preferably 50 to 80° C. as determined from a DSC curve upon its heating by a differential scanning calorimeter, are preferred because a toner excellent in balance between fixing ability and parting property upon fixing can be provided. A parting agent, which has a molecular weight of 1,000 or higher, dissolves in a proportion of at least 5 parts by weight in 100 parts by weight of styrene at 25° C. and has an acid value of at most 10 mg KOH/g, is particularly preferred because it exhibits a marked effect to lower a fixing temperature. As such polyfunctional ester compounds, are preferred dipentaerythritol hexamyristate and pentaerythritol tetrastearate. The endothermic peak temperature means a value measured in accordance with ASTM D 3418-82. The proportion of the parting agent incorporated is generally 3 to 20 parts by weight, preferably 5 to 15 parts by weight per 100 parts by weight of the binder resin.

The colored resin particles making up the toner used in the image forming method according to the present invention preferably contain a charge control agent. No particular limitation is imposed on the charge control agent so far as it is that used in the technical field of toners. Among charge control agents, a charge control resin is preferably contained because the charge control resin is high compatibility with the binder resin, colorless and can provide a toner having stable charging ability even in continuous color printing at a high speed. Examples of the charge control resin include positive charge control resins such as quaternary ammonium (salt) group-containing copolymers prepared in accordance with a process described in Japanese Patent Application Laid-Open No. 63-60458 (U.S. Pat. No. 4,840,863), Japanese Patent Application Laid-Open No. 3-175456, Japanese Patent Application Laid-Open No. 3-243954, Japanese Patent Application Laid-Open No. 11-15192 or the like; and negative charge control resins such as sulfonic (salt) group-containing copolymers prepared in accordance with a process described in Japanese Patent Application Laid-Open No. 1-217464 (U.S. Pat. No. 4,950,575), Japanese Patent Application Laid-Open No. 3-15858 or the like.

The proportion of a monomer unit having a functional group such as a quaternary ammonium (salt) group or sulfonic (salt) group contained in these copolymers is preferably 0.5 to 12% by weight, more preferably 1 to 8% by weight based on the weight of the charge control resin. When the proportion of the monomer unit containing the functional group falls within the above range, the charge level of the resulting toner is easy to be controlled, and the occurrence of fog can be lessened.

The weight average molecular weight of the charge control resin is preferably 2,000 to 50,000, more preferably 4,000 to 40,000, particularly preferably 6,000 to 35,000. When the weight average molecular weight of the charge control resin falls within the above range, the occurrence of offset and lowering of fixing ability can be inhibited.

The glass transition temperature of the charge control resin is preferably 40 to 80° C., more preferably 45 to 75° C., particularly preferably 45 to 70° C. When the glass transition temperature of the charge control resin falls within the above range, the storage stability and fixing ability of the resulting toner can be improved with them well balanced. The proportion of the charge control resin incorporated is generally 0.1 to 10 parts by weight, preferably 1 to 6 parts by weight per 100 parts by weight of the binder resin.

The colored resin particles are preferably provided as core•shell type (also referred to as "capsule type") colored resin particles obtained by combining 2 different polymers at the interior (core layer) and the exterior (shell layer) of each particle. The core•shell type colored resin particles are preferred because a low-softening point substance of the interior (core layer) is covered with a substance having a softening point higher than the low-softening point substance, whereby lowering (fixing ability) of a fixing temperature and prevention (storage stability) of aggregation upon storage can be well balanced with each other. The core layer of the core•shell type colored resin particles is composed of the above-described binder resin and a colorant, and various kinds of additives such as a charge control agent and a parting agent may be contained as needed. The shell layer is composed of a binder resin alone.

No particular limitation is imposed on the weight ratio of the core layer to the shell layer in each of the core•shell type colored resin particles. However, it is generally selected from a range of 80/20 to 99.9/0.1. The proportion of the shell layer is controlled within the above range, whereby the resulting toner can combine good storage stability with fixing ability at a low temperature.

The average thickness of the shell layer of the core•shell type colored resin particles is generally 0.001 to 0.1 μm, preferably 0.003 to 0.08 μm, more preferably 0.005 to 0.05 μm. If the thickness of the shell layer is too great, the fixing ability of the resulting toner is deteriorated. If the thickness is too small on the other hand, the storage stability of the resulting toner is deteriorated. All surfaces of the core particles forming the core•shell type colored resin particles may not be always covered with the shell layer so far as part of the surfaces of the core particles are covered with the shell layer.

The particle diameters of the core particles and the thickness of the shell layer in the core•shell type colored resin particles can be determined by directly measuring the size and shell thickness of each of particles selected at random from electron photomicrographs thereof when they can be observed through an electron microscope. If the core and shell in each particle are difficult to clearly observe through the electron microscope, the thickness of the shell layer can be calculated out from the particle diameter of the core particle and the amount of the monomer used for forming the shell upon the production of the toner.

With respect to the colored resin particles used in the present invention, no particular limitation is imposed on the production process thereof so far as those having the expected properties can be obtained. However, they are preferably produced by a polymerization process. Thus, a process for producing colored resin particles making up a toner by the polymerization process will hereinafter be described.

In order to produce the colored resin particles by the polymerization process, a colorant, a charge control agent and other additives are first dissolved or dispersed in a polymerizable monomer that is a raw material for a binder resin to prepare a polymerizable monomer composition. This polymerizable monomer composition is dispersed as fine droplets in an aqueous dispersion medium containing a dispersion stabilizer to conduct a polymerization reaction using a polymerization initiator. After the polymerization, the reaction product is subjected to filtration, washing, dehydration and drying, thereby obtaining colored resin particles.

As examples of the polymerizable monomer, may be mentioned monovinyl monomers, crosslinkable monomers and macromonomers. This polymerizable monomer is polymerized to become a binder resin component.

Examples of the monovinyl monomers include aromatic vinyl monomers such as styrene, vinyltoluene and α-methylstyrene; acrylic acid and methacrylic acid; alkyl (meth)acrylates such as methyl acrylate, ethyl acrylate, propyl acrylate, butyl acrylate, 2-ethylhexyl acrylate, cyclohexyl acrylate, isobonyl acrylate, methyl methacrylate, ethyl methacrylate, propyl methacrylate, butyl methacrylate, 2-ethylhexyl methacrylate, cyclohexyl methacrylate and isobonyl methacrylate; and monoolefin monomers such as ethylene, propylene and butylene. The monovinyl monomers may be used either singly or in any combination thereof. Among these monovinyl monomers, aromatic vinyl monomers, and combinations of an aromatic vinyl monomer and an alkyl (meth)acrylate are preferably used.

When a crosslinkable monomer is used together with the monovinyl monomer, hot offset of the resulting toner can be effectively improved. The crosslinkable monomer is a monomer having at least 2 vinyl groups. As specific examples thereof, may be mentioned divinylbenzene, divinylnaphthalene, ethylene glycol dimethacrylate, pentaerythritol triallyl ether and trimethylolpropane triacrylate. These crosslinkable monomers may be used either singly or in any combination thereof. The proportion of the crosslinkable monomer used is generally at most 10 parts by weight, preferably 0.1 to 2 parts by weight per 100 parts by weight of the monovinyl monomer.

It is preferable to use a macromonomer together with the monovinyl monomer because a balance between storage stability and fixing ability at a low temperature of the resulting toner is improved. The macromonomer is an oligomer or polymer having a polymerizable carbon-carbon unsaturated double bond at its molecular chain terminal and a number average molecular weight of generally 1,000 to 30,000.

The macromonomer is preferably that giving a polymer having a glass transition temperature higher than that of a polymer obtained by polymerizing the monovinyl monomer. The proportion of the macromonomer used is generally 0.01 to 10 parts by weight, preferably 0.03 to 5 parts by weight, more preferably 0.05 to 1 part by weight per 100 parts by weight of the monovinyl monomer.

As examples of the polymerization initiator, may be mentioned persulfates such as potassium persulfate and ammonium persulfate; azo compounds such as 4,4'-azobis(4-cyanovaleric acid), 2,2'-azobis(2-methyl-N-(2-hydroxy-ethyl) propionamide, 2,2'-azobis(2-amidinopropane) dihydrochloride, 2,2'-azobis(2,4-dimethylvaleronitrile) and 2,2'-azobisisobutyronitrile; and peroxides such di-t-butyl peroxide, benzoyl peroxide, t-butyl peroxy-2-ethylhexanoate, t-hexyl peroxy-2-ethyl hexanoate, t-butyl peroxypivalate, diisopropyl peroxydicarbonate, di-t-butyl peroxy-isophthalate and t-butyl peroxyisobutyrate. Redox initiators composed of combinations of these polymerization initiators with a reducing agent may also be used.

The proportion of the polymerization initiator used is generally 0.1 to 20 parts by weight, preferably 0.3 to 15 parts by weight, more preferably 0.5 to 10 parts by weight per 100 parts by weight of the polymerizable monomer. The polymerization initiator may be added into the polymerizable monomer composition in advance, but may also be added into the aqueous dispersion medium during or after the formation of the droplets of the polymerizable monomer composition for preventing undesirable premature polymerization.

A dispersion stabilizer is contained in the aqueous dispersion medium. Examples of the dispersion stabilizer include inorganic compounds, such as inorganic salts such as barium sulfate, calcium sulfate, calcium carbonate, magnesium carbonate and calcium phosphate; inorganic oxides such as aluminum oxide and titanium oxide; and inorganic hydroxides such as aluminum hydroxide, magnesium hydroxide and ferric hydroxide. As the dispersion stabilizer, may also be used water-soluble polymers such as polyvinyl alcohol, methyl cellulose and gelatin; and anionic surfactants, nonionic surfactants and amphoteric surfactants. These dispersion stabilizers may be used either singly or in any combination thereof.

Among the dispersion stabilizers, dispersion stabilizers containing inorganic compound, in particular, colloid of a hardly water-soluble metal hydroxide are preferred because the particle diameter distribution of the resulting colored resin particles can be narrowed, the amount of the dispersion stabilizer remaining after washing can be lessened, and a toner capable of brightly reproducing images is easy to be obtained.

The proportion of the dispersion stabilizer used is preferably 0.1 to 20 parts by weight per 100 parts by weight of the polymerizable monomer. When the amount of the dispersion stabilizer used falls within the above range, sufficient polymerization stability is achieved, so that the formation of polymer aggregates is inhibited. It is hence preferable to use the dispersion stabilizer within the above range.

Upon the polymerization, it is preferable to use a molecular weight modifier. Examples of the molecular weight modifier include mercaptans such as t-dodecyl-mercaptan, n-dodecylmercaptan and n-octylmercaptan. The molecular weight modifier may be added before the initiation of the polymerization or in the course of the polymerization. The proportion of the molecular weight modifier used is generally 0.01 to 10 parts by weight, preferably 0.1 to 5 parts by weight per 100 parts by weight of the polymerizable monomer.

No particular limitation is imposed on the process for producing the core•shell type colored resin particles, and they can be produced in accordance with a conventionally known process. Examples thereof include processes such as a spray drying process, interfacial reaction process, in-situ polymerization process and phase separation process. More specifically, colored resin particles obtained by a pulverization process, polymerization process, association process or phase-inversion emulsification process are used as core particles, and the core particles are covered with a shell layer, whereby the core•shell type colored resin particles can be obtained. Among these production processes, the in-situ polymerization process and phase-inversion emulsification process are preferred from the viewpoint of production efficiency.

The production process of the colored resin particles having the core-shell structure by the in-situ polymerization process will hereinafter be described. A polymerizable monomer (polymerizable monomer for shell) for forming a shell and a polymerization initiator are added into an aqueous dispersion medium with core particles (colored resin particles) dispersed therein to conduct polymerization, whereby colored resin particles having a core-shell structure can be obtained.

As specific processes for forming the shell, may be mentioned a process, in which a polymerizable monomer for shell is added into a reaction system of a polymerization reaction conducted for obtaining core particles to continuously conduct polymerization; a process, in which core particles obtained in a separate reaction system are charged, and a polymerizable monomer for shell is added thereto to conduct polymerization, and the like. The polymerizable monomer for shell may be added collectively into the reaction system, or may be added continuously or intermittently by means of a pump such as a plunger pump.

As the polymerizable monomer for shell, monomers respectively forming polymers having a glass transition temperature exceeding 80° C., such as styrene, acrylonitrile and methyl methacrylate, may be used either singly or in combination of two or more monomers thereof.

A water-soluble polymerization initiator is preferably added upon the addition of the polymerizable monomer for shell because the colored resin particles having the core-shell structure are easy to be obtained. It is considered that when the water-soluble polymerization initiator is added upon the addition of the polymerizable monomer for shell, the water-soluble polymerization initiator moves in the vicinity of each external surface of the core particles to which the polymerizable monomer for shell has migrated, and consequently a polymer layer (shell) is easy to be formed on each surface of the core particles.

As examples of the water-soluble polymerization initiator, may be mentioned persulfates such as potassium persulfate and ammonium persulfate; and azo type initiators such as 2,2'-azobis[2-methyl-N-(2-hydroxyethyl)-propionamide] and 2,2'-azobis[2-methyl-N-[1,1-bis-(hydroxymethyl)-2-hydroxyethyl]propionamide]. The proportion of the water-soluble polymerization initiator used is generally 0.1 to 30 parts by weight, preferably 1 to 20 parts by weight per 100 parts by weight of the polymerizable monomer for shell.

The polymerization temperature is preferably at least 50° C., more preferably 60 to 95° C. The polymerization reaction is preferably conducted for 1 to 20 hours, more preferably 2 to 10 hours. After completion of the polymerization, a process comprising filtration, washing, dehydration and drying is performed in accordance with a process known per se in the art. However, this process is preferably repeated several times.

When an inorganic compound such as an inorganic hydroxide has been used as the dispersion stabilizer, an acid or alkali is preferably added to the aqueous dispersion containing the colored resin particles (colored polymer particles) formed by the polymerization to dissolve the dispersion stabilizer in water so as to remove it by filtration and washing. When colloid of a hardly water-soluble inorganic hydroxide has been used as the dispersion stabilizer, an acid is preferably added to adjust the pH of the aqueous dispersion to 6.5 or lower. As the acid added, may be used an inorganic acid such as sulfuric acid, hydrochloric acid or nitric acid, or an organic acid such as formic acid or acetic acid. However, sulfuric acid is particularly preferred because of high removing efficiency and small burden on production equipment.

No particular limitation is imposed on a process of separating the colored resin particles from the aqueous dispersion medium by filtration and dehydrating them. As examples thereof, may be mentioned a centrifugal filtration process, a vacuum filtration process and a pressure filtration process. Among these, the centrifugal filtration process is preferred.

The toner used in the present invention is a developer comprising the colored resin particles and an external additive. Other fine particles may also be added as needed. The colored resin particles (including core•shell type colored resin particles) prepared by the polymerization process or the like may be used as a main component as various kinds of developers. However, it is preferably used as an one-component developer, more preferably as a non-magnetic one-component developer examples of the external additive include inorganic fine particles and organic resin fine particles functioning as a flowability improver and an abrasive.

Examples of the inorganic fine particles include silicon dioxide (silica), aluminum oxide (alumina), titanium oxide, zinc oxide, tin oxide, barium titanate and strontium titanate. Examples of the organic resin fine particles include particles of methacrylic ester polymers, acrylic ester polymers, styrene-methacrylic ester copolymers and styrene-acrylic ester copolymers, and core-shell type particles in which the core is composed of a styrene polymer, and the shell is composed of a methacrylic ester copolymer.

Among these, the inorganic fine particles are preferred, with silica being particularly preferred. The surfaces of the inorganic fine particles may be subjected to a hydrophobicity-imparting treatment, and silica particles subjected to the hydrophobicity-imparting treatment are particularly preferred. Two or more of the external additives may be used in combination. When the external additives are used in combination, it is preferable to use two or more kinds of inorganic fine particles, or inorganic fine particles and organic resin fine particles, which are different in average particle diameter from each other, in combination.

The inorganic fine particles such as silica are preferably subjected to a hydrophobicity-imparting treatment. The inorganic fine particles subjected to the hydrophobicity-imparting treatment are generally commercially available. However, they may be obtained by subjecting untreated inorganic fine particles to a hydrophobicity-imparting treatment with a silane coupling agent, silicone oil or the like. Methods for the hydrophobicity-imparting treatment include a method, in which silicone oil or the like that is a treating agent is added dropwise or sprayed while stirring the above-described fine particles at a high speed, a method, in which the fine particles are added and mixed with an organic solvent in which the treating agent has been dissolved, and which is being stirred, and then subjected to a heat treatment, and the like. In the case of the former, the treating agent may be diluted with an organic solvent or the like.

The degree of the hydrophobicity imparted is preferably 20 to 90%, more preferably 40 to 80% in terms of the degree of hydrophobicity as determined by a methanol method. When the degree of hydrophobicity falls within this range, the resulting fine particles are hard to absorb moisture under a high-temperature and high-humidity environment and can attain sufficient abrasion property.

No particular limitation is imposed on the proportion (total proportion of external additives used singly or in combination) of the external additive used. However, it is generally 0.1 to 6 parts by weight per 100 parts by weight of the colored resin particles. The adhesion of the external additive to the colored resin particles is generally conducted by charging the colored resin particles and the external additive into a mixer such as a Henschel mixer to stir them.

Fine silica particles (A), the number average particle diameter of primary particles of which is 5 to 20 nm, preferably 7 to 15 nm, and spherical fine silica particles (B) having a volume average particle diameter from 0.1 to 0.5 μm are preferably used in combination as the external additives. Fine silica particles (C), the number average particle diameter of primary particles of which is 25 to 80 nm, preferably 30 to 60 nm, are additionally combined. The combined use of these fine particles can inhibit the formation of a toner film on the surface of a photosensitive member and blurring of an image formed.

The spherical fine silica particles (B) have a spheroidicity from 1 to 1.5, preferably from 1 to 1.3, more preferably from 1 to 1.2 as determined by a method which will be described subsequently. The spheroidicity is controlled within the above range, whereby the transferability of the resulting toner can be improved.

Assuming that in a particle diameter distribution, a particle diameter corresponding to 10% in a volume particle diameter counting from the side of a smaller particle diameter is Dv10, and a particle diameter corresponding to 50% likewise is Dv50, the spherical fine silica particles (B) are preferably such that a ratio (Dv50/Dv10) of Dv 50 to Dv10 is at least 1.8, more preferably at least 2.0. When spherical fine silica particles having a Dv50/Dv10 ratio higher than 1.8 are used, blocking of the resulting toner and toner filming on a photosensitive member can be effectively inhibited.

The bulk density of the spherical fine silica particles (B) is preferably 50 to 250 g/little, more preferably 80 to 200 g/little. The bulk density is controlled within this range, whereby occurrence of toner filming on a photosensitive member and fog, and lowering of cleaning ability can be inhibited.

The proportion of the fine silica particles (A) incorporated is preferably 0.1 to 3 parts by weight, more preferably 0.3 to 2 parts by weight per 100 parts by weight of the colored resin particles. The proportion of the fine silica particles (A) incorporated is controlled within the above range, whereby occurrence of lowering of cleaning ability, and print soiling and fixing failure under a low-temperature and low-humidity environment can be effectively inhibited.

The proportion of the spherical fine silica particles (B) incorporated is preferably 0.3 to 3 parts by weight, more preferably 0.5 to 2 parts by weight per 100 parts by weight of the colored resin particles. The proportion of the spherical fine silica particles (B) incorporated is controlled within the above range, whereby occurrence of lowering of cleaning ability and blurring of the resulting image can be inhibited.

The proportion of the fine silica particles (C) incorporated is preferably 0.1 to 3 parts by weight, more preferably 0.3 to 2 parts by weight per 100 parts by weight of the colored resin particles. The proportion of the fine silica particles (C) incorporated is controlled within the above range, whereby occurrence of lowering of cleaning ability, and print soiling and fixing failure under a low-temperature and low-humidity environment can be effectively inhibited.

According to the present invention, there can be provided an image forming method, by which even when a spherical and small-sized toner is used for forming a high-resolution and high-definition image in an image forming process of the electrophotographic system, the toner remaining on the surface of a photosensitive member after a transfer step can be efficiently removed by using a cleaning blade, and high-definition and high-quality images can be formed even under low-temperature and low-humidity, and high-temperature and high-humidity environments, to say nothing of normal-temperature and normal-humidity environment.

According to the image forming method of the present invention, even a spherical and small-sized toner can be effectively cleaned off by modifying the surface characteristics of a developing roll, selecting a material and properties of a cleaning blade and controlling toner properties such as the absolute value of charge level of the toner on the surface of the photosensitive member, and a high-definition and high-quality image can be formed.

EXAMPLES

The present invention will hereinafter be described more specifically by the following production examples, synthesis examples, examples and comparative examples. In the following production examples, examples and comparative examples, all designations of "part" or "parts" and "%" mean part or parts by weight and % by weight unless expressly noted. In the present invention, the evaluation methods of properties or characteristics and physical properties are as follows.

(1) Volume Average Diameter and Particle Diameter Distribution of Colored Resin Particles:

The volume average particle diameter dv and particle diameter distribution represented by a ratio dv/dp of the volume average particle diameter dv to the number average particle diameter dp of colored resin particles were measured by means of a particle diameter meter (manufactured by Beckmann Coulter Co., trade name "MULTISIZER") This measurement was conducted under the following conditions:

| | |
|---|---|
| aperture diameter: | 100 μm; |
| medium: | Isothone |
| sample concentration: | 10%; and |
| the number of particles measured: | 100,000 particles. |

(2) Average Circularity:

A container was charged with 10 ml of ion-exchanged water in advance, 0.02 g of a surfactant (alkylbenzenesulfonic acid) as a dispersing agent was added thereto, and 0.02 g of colored resin particles were further added to conduct a dispersing treatment for 3 minutes at 60 W by means of an ultrasonic disperser. The concentration of the colored resin particles upon measurement was adjusted to 3,000 to 10,000 particles/μL to conduct measurement as to 1,000 to 10,000 colored resin particles corresponding to circles having a diameter of 1 μm or greater by means of a Flow Particle Image Analyzer (manufactured by SYSMEX CORPORATION, trade name "FPIA-2100"). An average circularity was found from the measured values.

(3) Average Particle Diameter and Particle Diameter Distribution (Dv50/Dv10) of Spherical Fine Silica Particles:

After 0.5 g of fine silica particles were placed in a 100-ml beaker, some drops of a surfactant were added dropwise, and 50 ml of ion-exchanged water was added to disperse the particles for 5 minutes by means of an ultrasonic homogenizer (trade name "US-150T"), a volume average particle diameter and a particle diameter distribution were measured by means of a particle size distribution measuring device (manufactured by Nikkiso Co., Ltd., trade name "MICROTRACK UPA150",).

(4) Number Average Particle Diameter of Fine Silica Particles:

The number average particle diameter of fine silica particles was determined by photographing each of particles by an electron microscope, and processing the resultant photographs by means of an image processing analyzer (manufactured by NIRECO Corporation, trade name "LUZEX IID") under conditions of an area rate of particles to a frame area of 2% in maximum and a total processing number of 100 particles to calculate out circle-corresponding diameters of the particles, thereby finding an average value thereof.

(5) Spheroidicity:

The spheroidicity Sc/Sr that is a value obtained by dividing an area Sc of a circle supposing that the absolute maximum length of a spherical fine silica particle is a diameter by a substantial projected area Sr of the particle was determined by photographing each of the particles by an electron microscope, processing the resultant photographs by means of the image processing analyzer (manufactured by NIRECO Corporation, trade name "LUZEX IID") under conditions of an area rate of particles to a frame area of 2% in maximum and a total processing number of 100 particles and averaging the thus-obtained spheroidicity values of the 100 particles.

(6) Degree of Hydrophobicity:

The degree of hydrophobicity of spherical fine silica particles was determined by a methanol method. A 500-ml beaker was charged with 0.2 g of fine silica particles, 50 ml of purified water was added, and methanol was added to under the liquid level while stirring by a magnetic stirrer. A point that no fine particle was observed on the liquid level was regarded as an end point to calculate out the degree of hydrophobicity in accordance with the following equation:

$$\text{Degree of hydrophobicity (\%)}=[X/(50+X)]\times 100$$

In the above equation, X is an amount (ml) of methanol used.

(7) Bulk Density:

Spherical fine silica particles to be measured were gradually added without applying vibration into a 100-ml measuring cylinder weighed in advance. When the particles were added to 100 ml, the measuring cylinder was weighed together with the particles to calculate out a difference in weight between before and after the addition of the fine silica particles. The value thereof was multiplied by 10 to regard the product as the bulk density (g/l) of the spherical fine silica particles (B).

Figure 4:
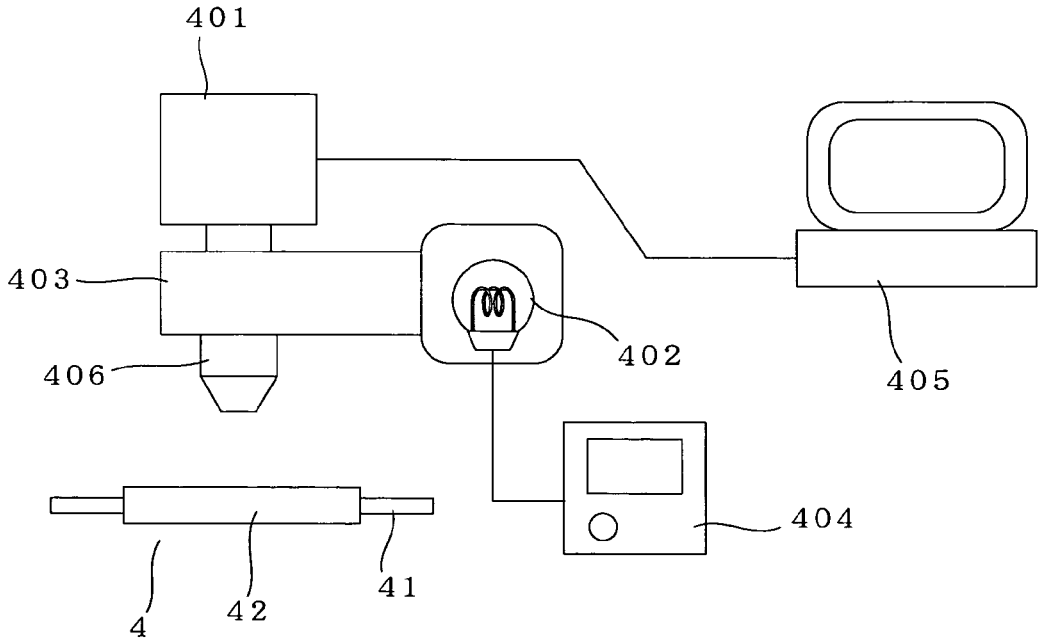
FIG. 4 illustrates a surface brightness value measuring apparatus.

(8) Surface Brightness:

The surface brightness of a developing roll was determined by a surface brightness value measuring apparatus illustrated in FIG. 4. This surface brightness value measuring apparatus is equipped with a microscope body 403 (manufactured by NIKON CORP., trade name "EPI-U") composed of an objective 406 (product of NIKON CORP., trade name "CFIC BD PLAN 20X"), a CCD camera 401 (manufactured by SONY CORP., trade name "XC-003") and an illuminating lamp 402 (PHILLIBS 77241), a developing roll 4 is set below this microscope body 403, and a voltage applied to the illuminating lamp 402 is regulated to DC 10 V by a voltage regulator 404 to illuminate the developing roll 4 by a vertical illumination system.

The CCD camera 401 is connected to a computer 405, in which an image processing software (product of Oji Scientific Instruments, trade name "DA-6000") has been installed, and inputs an image taken into the computer 405 to analyze the image by the image processing software, thereby determining a surface brightness value. Upon the determination, surface brightness values at 3 places per developing roll were determined to use an average value thereof.

(9) Surface Roughness Rz:

A developing roll was set in a surface roughness meter [manufactured by Tokyo Seimitsu Co., Ltd., trade name "590A"] equipped with a measuring probe having a tip diameter of 2 μm to measure a surface roughness Rz under conditions of a measuring length of 2.4 mm, a cutoff wavelength of 0.8 mm and a cutoff classification of Gaussian. The surface roughness was measured at a measurement frequency of 3 places per developing roll to use an average value thereof.

(10) Electric Resistance:

An ohmmeter (manufactured by ADVANTEST CORPORATION, trade name "ULTRA HIGH RESISTANCE METER R8340A") was used, a developing roll was horizontally placed, an aluminum plate having a thickness of 5 mm, a width of 30 mm and a length capable of placing the whole rubber portion of the roll thereon was used as an electrode, a load of 500 g was applied to both ends of a developing roll metal core, and a direct current of 100 V was passed through between the metal core and the electrode to read a value after a second, thereby regarding the value as an electric resistance value.

(11) Viscoelastic Properties of Cleaning Blade:

The viscoelastic properties of a cleaning blade made of a polyurethane elastomer were measured under the following conditions:

| | |
|---|---|
| Viscoelastometer: | manufactured by Rheology Co., trade name: DVD-V4; |
| Size of measurement sample: | 20 mm long × 5 mm broad; |
| Initial distortion: | 0.3 mm; |
| Amplitude: | 40 μm; |
| Frequency: | 10 Hz; |
| Heating rate: | 2.5° C./min. |

(12) Hardness of Cleaning Blade:

The hardness of a cleaning blade was measured in accordance with a spring type Durometer hardness (A-type) test prescribed in JIS (Japanese Industrial Standards) K 6253. A specimen obtained by superimposing 6 formed sheets each having a thickness of 1.6 mm so as to give a total thickness of 9.6 mm was used as a measurement sample for hardness.

(13) Charge Level |Q| (μC/g) of Toner on Photosensitive Member:

The charge level of a toner on a photosensitive member is a value measured in accordance with the following method. A printer obtained by modifying a photosensitive drum, a developing roll and a cleaning blade of a commercially-available non-magnetic one-component color printer (manufactured by Oki Data Corporation, model name "MICROLINE 5300") was used.

A cartridge charged with a toner prepared in a Production Example was installed at a position of a black toner cartridge in the modified printer. After the printer was left to stand for a day under a normal-temperature and normal-humidity (N/N) environment of 23° C. in temperature and 50% in humidity, solid printing was conducted. After the next solid printing was stopped on the way, the toner used in development on the photosensitive member was sucked by means of a suction type charge level meter (manufactured by TREK JAPAN K.K., model name "210HS-2A") to measure a charge level. A charge level Q (μC/g) per unit weight of the toner was calculated out on the basis of the weight (g) of the toner sucked and a value (μC) of the charge level measured. The charge level is represented by the absolute value |Q| thereof. At this time, the penetration and set angle θ of the cleaning blade were determined to be 1.2 mm and 25°, respectively.

(14) Amount (Development Rate) M/A (mg/cm$^2$) of Toner on Photosensitive Member:

After solid printing was conducted in the same manner as described above, and the next solid printing was stopped on the way, the toner used in development on the photosensitive member was sucked by means of the suction type charge level meter used in the above item (13). A filter, the weight of which has been precisely measured in advance, was fitted into a Faraday gage of this charge level meter, a filter area A (cm$^2$) of a sucked portion after the suction was measured, and a development rate M/A (mg/cm$^2$) was calculated out from this measured value A and an increment [i.e., amount M (mg) of the toner sucked] in weight of the Faraday gage.

(15) Extract pH:

Six grams of a toner was dispersed in 100 g of ion-exchanged water adjusted to pH 7 by a cation exchange treatment and an anion exchange treatment, and the resultant dispersion was heated and boiled. After the boiled state was retained for 10 minutes (10-minute boiling), ion-exchanged water adjusted to pH 7 by a cation exchange treatment and an anion exchange treatment, which had been separately boiled for 10 minutes, was successively added to the original volume before the boiling, and the dispersion thus treated was cooled to room temperature (25° C.). The pH of an extract obtained in such a manner was measured by means of a pH meter.

(16) Printing Density:

After paper for printing was set in the printer modified in the item (13) under an N/N environment of 23° C. in temperature and 50% in humidity, a toner was charged into a developing device of this printer, and the printer was left to stand for a day, printing was continuously conducted from the beginning at a printing density of 5%, and solid printing was conducted upon printing on the tenth paper sheet to measure a printing density by means of a McBeth reflection type image density meter. After the toner for development of electrostatic images was left to stand for 2 weeks under an H/H (30° C./80% RH) environment of 30° C. in temperature and 80% in humidity, the toner was charged into the developing device likewise to measure a printing density in the same manner as described above.

(17) Durability:

After the printer modified in the item (13) was used and left to stand for a day under each environment of an N/N environment of 23° C. in temperature and 50% in humidity, and an H/H environment of 35° C. in temperature and 80% in humidity, printing was continuously conducted at a density of 5%. Every 500 sheets of paper, white solid printing was conducted, a toner present on the photosensitive member after development was applied to a adhesive tape (product of Sumitomo 3M Limited, "Scotch Mending Tape 810-3-18"), and this adhesive tape was stuck on new paper for printing. A color tone B of the paper for printing, on which this adhesive tape had been stuck, was measured by a spectroscopic color-difference meter (manufactured by Nippon Denshoku K.K., model name "SE2000"). A color tone A of paper for printing, on which only a pressure-sensitive adhesive tape had been stuck, was measured likewise. Their color tones were represented as coordinates of the L*a*b* color space to calculate out a color difference ΔE* from the 2 color tones to regard it as a fog value. The number of sheets of paper printed that can retain this value less than 1% was determined by 10,000 sheets of paper. 10000≦ in Table indicates that fog does not exceed 1% even when printing is continuously conducted on 10,000 sheets of paper.

(18) Cleaning Ability:

After the printer modified in the item (13) was used and left to stand for a day under each environment of an L/L environment of 10° C. in temperature and 20% in humidity, and an N/N environment of 23° C. in temperature and 50% in humidity, printing was continuously conducted at a density of 5%. Every 500 sheets of paper, whether the toner passed through under the cleaning blade to adhere to a charging roll, or not was visually evaluated. The evaluation was made to 10,000 sheets of paper. 10000≦ in Table indicates that no toner adhere to the charging roll even when printing is continuously conducted on 10,000 sheets of paper.

Production Example 1

Photosensitive Drum A

A non-cut cylindrical drum (non-cut cylinder) having a diameter of 30 mm and composed of an aluminum alloy was coated with a coating liquid obtained by dissolving titanium oxide particles coated with alumina and polyamide acid (product of I.S.T Corporation, trade name "PYRE ML") in a proportion of 1:1 in terms of a weight ratio in dimethylformamide and dried for 30 minutes at 140° C. to form an undercoating layer having a thickness of 20 μm. A dispersion obtained by dissolving polyvinyl butyral as a binder resin and oxytitanium phthalocyanine as a charge-generating agent in a proportion of 1:1 in terms of a weight ratio in methyl ethyl ketone was then applied by dip coating so as to give a thickness of 0.1 μm, thereby forming a charge generation layer.

A siloxane skeletal-containing polycarbonate copolymer resin (viscosity average molecular weight: 40,000, product of Idemitsu Kosan Co., Ltd.) as a binder resin, a butadiene compound as a charge-transporting agent and 2,6-di-tert-butyl-4-methylphenol as an antioxidant were dissolved at a weight ratio of 1.0/0.8/0.18 in tetrahydrofuran to prepare a coating liquid. This coating liquid was applied on to the charge generation layer by dip coating and then dried for 1 hour at 100° C. to form a charge transport layer having a thickness of 20 μm. A photosensitive drum A was produced in such a manner.

Production Example 2

Developing Roll A

A shaft having a diameter of 10 mm and a length of 275 mm and obtained by subjecting an iron rod material: SUM22 [JIS (Japanese Industrial Standards), a rod material excellent in cuttability and easy to be machined] to electroless plating with nickel was used as an electrically conductive shaft and coated with a silicone primer (product of Shin-Etsu Chemical Co., Ltd., trade name "PRIMER NO. 16"), and the thus-coated shaft was subjected to a baking treatment for 10 minutes at 150° C. in a Geer oven.

To 100 parts of methylvinylsilicone raw rubber (product of Shin-Etsu Chemical Co., Ltd., trade name "KE-78VBS"), were added 20 parts of dimethylsilicone raw rubber (product of Shin-Etsu Chemical Co., Ltd., trade name "KE-76VBS"), 10 parts of carbon black (product of Asahi Carbon Co., Ltd., trade name "ASAHITHERMAL"), 15 parts of fumed silica (product of Nippon Aerosil Co., Ltd., trade name "AEROSIL 200"), 0.5 part of a platinum catalyst (product of Shin-Etsu Chemical Co., Ltd., trade name "C-19A") and 2 parts of hydrogen siloxane (product of Shin-Etsu Chemical Co., Ltd., trade name "C-19B"), and the resultant mixture was kneaded by a pressure kneader to prepare a silicone rubber composition.

The silicone rubber composition was then integrally extruded through crosshead by an extruder to heat and vulcanize the extrudate for 30 minutes at 250° C. in a Geer oven, thereby vulcanization-bonding it to the electrically conductive shaft composed of the shaft so as to give a diameter of 18 mm. Secondary vulcanization was conducted for 4 hours at 200° C. in the Geer oven to form an elastic layer. After the vulcanization, the external periphery (surface) of the elastic layer was polished by a cylindrical grinder equipped with a grindstone of GC#400 to produce a roll base having a diameter of 16 mm and a rubber portion length of 230 mm. This roll base had a surface brightness of 32 and a surface roughness Rz of 25 μm.

The surface of this elastic layer was coated once with a coating liquid obtained by adding 10 parts of a fumed silica filler (product of Nippon Aerosil Co., Ltd., trade name "AEROSIL 200") and 10 parts of a polyisocyanate crosslinking agent (product of Nippon Polyurethane Industry Co., Ltd., trade name "CORONATE L") to 100 parts of a urethane paint (product of Nippon Polyurethane Industry Co., Ltd., trade name "NIPPORAN 5196"; nonvolatile content: 30%) by spray coating, and the coating liquid was heated and cured at 150° C. for 30 minutes to produce a developing roll B having a surface brightness value of 83 and a surface roughness Rz of 6 μm. The electric resistance of this developing roll A was 7.7 (Log Ω·cm)

Production Example 3

Developing Roll B

An electrically conductive shaft and an elastic layer were respectively produced in accordance with the same processes as in Production Example 2, and the surface of this elastic layer was coated once with a coating liquid obtained by adding 5 parts of a fumed silica filler (product of Nippon Aerosil Co., Ltd., trade name "AEROSIL 200") and 10 parts of a polyisocyanate crosslinking agent (product of Nippon Polyurethane Industry Co., Ltd., trade name "CORONATE L") to 100 parts of a urethane paint (product of Nippon Polyurethane Industry Co., Ltd., trade name "NIPPORAN 5196"; nonvolatile content: 30%) by spray coating. The coating liquid was heated and cured at 150° C. for 30 minutes to produce a developing roll B. This developing roll B had a surface brightness of 121 and a surface roughness Rz of 6.0 μm. The electric resistance of this developing roll B was 7.6 (log Ω·cm).

Production Example 4

Developing Roll C

An electrically conductive shaft and an elastic layer were respectively produced in accordance with the same processes as in Production Example 2, and the surface of the elastic layer was polished. The surface of this elastic layer was coated once with a coating liquid obtained by adding 10 parts of a polyisocyanate crosslinking agent (product of Nippon Polyurethane Industry Co., Ltd., trade name "CORONATE L") to 100 parts of a urethane paint (product of Nippon Polyurethane Industry Co., Ltd., trade name "NIPPORAN 5196"; nonvolatile content: 30%) by spray coating. The coating liquid was heated and cured at 150° C. for 30 minutes to produce a developing roll C. This developing roll C had a surface brightness of 230 and a surface roughness Rz of 0.7 μm. The electric resistance of this developing roll C was 7.7 (log Ω·cm).

Production Example 5

Developing Roll D

After an electrically conductive shaft and an elastic layer were respectively produced in accordance with the same processes as in Production Example 2, the surface of the elastic layer was polished by a cylindrical grinder equipped with a grindstone of GC#120. This developing roll D had a surface brightness of 20 and a surface roughness Rz of 25.0 μm. The electric resistance of this developing roll D was 7.5 (log Ω·cm)

Production Example 6

Cleaning Blade A

In a nitrogen atmosphere, 59.81 g of a bifunctional polyester polyol compound obtained by subjecting ∈-caprolactone to ring-opening addition to neopentyl glycol (NPG) [i.e., poly(∈-caprolactone polyol) using NPG as an initiator; product of Daicel Chemical Industries, Ltd., trade name "PLACCEL 230CP", number average molecular weight: 3,000] and 40.19 g of 4,4'-diphenylmethane diisocyanate (MDI) were reacted for 3 hours at 80° C. to obtain an NCO group-terminated prepolymer (pseudo-prepolymer).

To this NCO group-terminated prepolymer, were added 25.50 g of a bifunctional polyester polyol compound obtained by subjecting ∈-caprolactone to ring-opening addition to ethylene glycol [i.e., poly(∈-caprolactone polyol) using ethylene glycol as an initiator; product of Daicel Chemical Industries, Ltd., trade name "PLACCEL 220", number average molecular weight: 2,000], 3.04 g of trimethylolpropane (TMP) as a crosslinking agent and 7.37 g of 1,4-butanediol (BD) as a chain-lengthening agent, and the resultant mixture was stirred to prepare a reactive composition.

The reactive composition was deaerated under reduced pressure, and then cast into a mold to react it for 1 hour at 150° C., thereby molding a polyurethane elastomer sheet having a thickness of 1.6 mm. After the sheet was taken out of the mold and post-cured for 6 hours at 120° C., it was left to stand for 7 days at room temperature to age it. The sheet in such a manner was cut into a predetermined form (12 mm long by 238 mm broad) to obtain a cleaning blade A.

The cleaning blade A had an NPG content of 3.6% by weight based on the whole amount of the polyester polyol, a hardness of 72, a peak value of tan δ of 0.82, a peak temperature of tan δ of 2° C. and a width at half maximum of tan δ of at least 30° C.

On the other hand, a polyester resin (product of Arakawa Chemical Industries, Ltd., trade name "LUNAPER 1416", Tg=62° C., acid value=8, hydroxyl value=14, molecular weight distribution Mw/Mn=8,600/3,500=2.5) was kneaded, roughly ground at a roll temperature of 110° C., cooled and then pulverized. The fine polyester resin particles thus pulverized were classified to obtain indefinable fine resin particles having an average particle diameter of 3 μm.

After the surface of the cleaning blade A was washed with isopropyl alcohol and dried, a neutral detergent (product of Fuji Photo Film Co., Ltd., trade name "DRYWELL") was thinly applied to a 2-mm portion of a tip smooth part of the cleaning blade A and its side coming into contact with a photosensitive member in a 5-mm width. The indefinable fine resin particles were struck against the surface of the cleaning blade A wetted with the neutral detergent to be coated. If the thickness of the fine resin particles is uneven, the cleaning blade A was lightly struck to be shocked in order for excess fine resin particles to fall off from thick portions. Thereafter, the cleaning blade A was dried for a day at 40° C. in a dryer to fix the fine resin particles to the surface of the cleaning blade A.

This cleaning blade A was bonded to a predetermined fitting with a hot-melt adhesive to obtain a cleaning blade unit. This unit was combined with a photosensitive drum.

Production Example 7

Cleaning Blade B

A cleaning blade B was produced in the same manner as in Production Example 6 except that the amounts of the trade name "PLACCEL 220", TMP and BD used were changed from 25.50 g to 16.70 g, from 3.04 g to 5.70 g and from 7.37 g to 5.20 g, respectively.

The cleaning blade B had an NPG content of 4.1% by weight based on the whole amount of the polyester polyol, a hardness of 70, a peak value from tan δ of 0.80, a peak temperature from tan δ of 7° C. and a width at half maximum of tan δ of at least 32° C.

The indefinable fine resin particles were fixed to the surface of the cleaning blade B in the same manner as in Production Example 6. This cleaning blade B was bonded to a predetermined fitting with a hot-melt adhesive to obtain a cleaning blade unit. This unit was combined with a photosensitive drum in the same manner as in Production Example 6.

Production Example 8

Cleaning Blade C

A cleaning blade C was produced in the same manner as in Production Example 6 except that the amounts of the trade name "PLACCEL 220", TMP and BD used were changed from 25.50 g to 27.24 g, from 3.04 g to 2.31 g and from 7.37 g to 7.91 g, respectively.

The cleaning blade C had an NPG content of 3.6% by weight based on the whole amount of the polyester polyol, a hardness of 74, a peak value of tan δ of 0.83, a peak temperature of tan δ of −4° C. and a width at half maximum of tan δ of at least 28° C.

The indefinable fine resin particles were fixed to the surface of the cleaning blade C in the same manner as in Production Example 6. This cleaning blade C was bonded to a predetermined fitting with a hot-melt adhesive to obtain a cleaning blade unit. This unit was combined with a photosensitive drum in the same manner as in Production Example 6.

Production Example 9

Cleaning Blade D

An NCO group-terminated prepolymer was synthesized by using 56.88 g of the trade name "PLACCEL 220" and 43.12 g of MDI in place of the trade name "PLACCEL 230CP". Then, 57.48 g of the trade name "PLACCEL 220", 2.23 g of TMP and 6.85 g of BD were added to the NCO group-terminated prepolymer to prepare a reactive composition. This reactive composition was used to produce a cleaning blade D in the same manner as in Production Example 6.

The cleaning blade D had an NPG content of 0% by weight based on the whole amount of the polyester polyol, a hardness of 70, a peak value of tan δ of 1.00, a peak temperature of tan δ of −16° C. and a width at half maximum of tan δ of at least 23° C.

This cleaning blade D was bonded to a predetermined fitting with a hot-melt adhesive to obtain a cleaning blade unit. This unit was combined with a photosensitive drum in the same manner as in Production Example 6.

Production Example 10

Cleaning Blade E

An NCO group-terminated prepolymer was synthesized by using 56.86 g of the trade name "PLACCEL 220" and 43.12 g of MDI in place of the trade name "PLACCEL 230CP". Then, 29.48 g of the trade name "PLACCEL 220", 3.12 g of TMP and 7.12 g of BD were added to the NCO group-terminated prepolymer to prepare a reactive composition. This reactive composition was used to produce a cleaning blade E in the same manner as in Production Example 6.

The cleaning blade E had an NPG content of 0% by weight based on the whole amount of the polyester polyol, a hardness of 72, a peak value of tan δ of 1.00, a peak temperature of tan δ of 12° C. and a width at half maximum of tan δ of at least 30° C.

The indefinable fine resin particles were fixed to the surface of the cleaning blade E in the same manner as in Production Example 6. This cleaning blade E was bonded to a predetermined fitting with a hot-melt adhesive to obtain a cleaning blade unit. This unit was combined with a photosensitive drum in the same manner as in Production Example 6.

Production Example 11

Negative Charge Control Resin 1

Into 900 parts of toluene, was poured 100 parts of a polymerizable monomer component composed of 85% of styrene, 13% of n-butyl acrylate and 2% of 2-acrylamido-2-methylpropanesulfonic acid, and the monomer component was reacted for 8 hours at 80° C. in the presence of 4 parts of azobisdimethylvaleronitrile. After completion of the reaction, toluene was distilled off under reduced pressure to obtain a sulfonic group-containing copolymer. The weight average molecular weight (Mw) of the sulfonic group-containing copolymer was 22,000. This sulfonic group-containing copolymer is referred to as a negative charge control resin 1 (CCR1). The content of "a structural unit having a functional group" in CCR1 is 2% by weight.

Production Example 12

Negative Charge Control Resin 2

Into 900 parts of toluene, was poured 100 parts of a polymerizable monomer component composed of 82% of styrene, 11% of n-butyl acrylate and 7% of 2-acrylamido-2-methylpropanesulfonic acid, and the monomer component was reacted for 8 hours at 80° C. in the presence of 4 parts of azobisdimethylvaleronitrile. After completion of the reaction, toluene was distilled off under reduced pressure to obtain a sulfonic group-containing copolymer. The weight average molecular weight (Mw) of the sulfonic group-containing copolymer was 10,000. This sulfonic group-containing copolymer is referred to as a negative charge control resin 2 (CCR2). The content of "a structural unit having a functional group" in CCR2 is 7% by weight.

Production Example 13

Spherical Fine Silica Particles 1

A hundred parts of mixed powder composed of 1.0 mol, in terms of an $SiO_2$ content, of silica powder (average particle diameter: 2 μm, maximum particle diameter: 60 μm) and 0.8 mol of metal silicon powder (average particle diameter: 10 μm, maximum particle diameter: 100 μm) was mixed with 50 parts of purified water, and the resultant mixture was placed in a thin-wall container to continuously feed it to an electric oven of 2,000° C. batch-wise. Hydrogen gas was introduced from the same direction as in the feeding of the raw mixture, the hydrogen gas and generated gases were sucked by an exhaust blower provided at an upper part in an opposite direction in the oven, the mixture was further brought into contact with air at a rate of 400 $Nm^3$/hr, and fine silica particles formed were collected by a bag filter while cooling them. The fine silica particles were classified by an air classifier. The resultant fine silica particles were such that the Dv50/Dv10 is 2.54, the volume average particle diameter of primary particles thereof is 0.2 μm, and the spheroidicity is 1.12.

Hexamethylenedisilazane diluted with alcohol was added dropwise to the fine silica particles in such a manner that the amount of hexamethylenedisilazane amounts to 1%, and the resultant mixture was heated for 30 minutes at 70° C. while vigorously stirring the mixture. The solvent was then removed at 140° C., and the fine particles thus obtained were subjected to a heat treatment for 4 hours at 210° C. while vigorously stirring them to obtain spherical fine silica particles 1 subjected to the hydrophobicity-imparting treatment. The degree of hydrophobicity of the resultant spherical fine silica particles 1 was 70%, and the bulk density thereof was 110 g/liter.

Production Example 14

Toner A

A polymerizable monomer composition for core was obtained by wet-pulverizing 80.5 parts of styrene, 19.5 parts of n-butyl acrylate, 0.5 part of a polymethacrylic ester macromonomer (product of Toagosei Chemical Industry Co., Ltd., trade name "AA6", Tg=94° C.), 0.6 part of divinylbenzene, 1.2 parts of t-dodecylmercaptan and 7 parts of a magenta pigment (product of Clariant Co., trade name "C.I. PIGMENT RED 122") by means of a media type wet pulverizer (manufactured by ASADA IRON WORKS CO., LTD., trade name "PICOMILL") and then adding, mixing and dissolving 3 parts of the negative charge control resin 1 (CCR1) and 10 parts of dipentaerythritol hexamyristate.

On the other hand, an aqueous solution with 6.8 parts of sodium hydroxide dissolved in 50 parts of ion-exchanged water was gradually added to an aqueous solution with 11.8 parts of magnesium chloride dissolved in 250 parts of ion-exchanged water with stirring to prepare a colloidal dispersion of magnesium hydroxide.

On one hand, 2.0 parts of methyl methacrylate and 65 parts of water were mixed to obtain an aqueous dispersion of a polymerizable monomer for shell.

The polymerizable monomer composition for core obtained in the above-described manner was poured into the colloidal dispersion of magnesium hydroxide obtained in the above-described manner, and the resultant mixture was stirred.

After 6 parts of t-butyl peroxyisobutyrate (product of Nippon Oil & Fats Co., Ltd., trade name "PERBUTYL TB") was then added to the mixture, the resultant dispersion was stirred 30 minutes at 15,000 rpm under high shearing force by means of an Ebara Milder (manufactured by Ebara Corporation, Model "MDN303V TYPE") to form droplets of the polymerizable monomer composition for core.

A reactor equipped with an agitating blade was charged with the colloidal dispersion of magnesium hydroxide, in which the droplets of the polymerizable monomer composition for core had been dispersed, and heating was started to control the dispersion so as to keep the temperature constant at 95° C. After a conversion into a polymer reached almost 100%, the aqueous dispersion of the polymerizable monomer for shell was added, 0.3 parts of a water-soluble initiator (product of Wako Pure Chemical Industries, Ltd., trade name "VA-086"; 2,2'-azobis[2-methyl-N-(2-hydroxyethyl)propionamide] was dissolved, and the resultant solution was then added to the reactor. After the polymerization was continued for 4 hours, the reaction was stopped to obtain an aqueous dispersion of core•shell type polymer particles.

The thus-obtained aqueous dispersion of the polymer particles was washed (at 25° C. for 10 minutes) with sulfuric acid while stirring at room temperature, thereby adjusting the pH of the aqueous dispersion to 4.5. After this aqueous dispersion was filtered and dehydrated, 250 parts of ion-exchanged water of 40° C. was additionally added to conduct washing. After the thus-treated aqueous dispersion was filtered and dehydrated, washing with ion-exchanged water of 40° C. was conducted again in the same manner. After the washing, colored resin particles were obtained by drying.

To 100 parts of the colored resin particles obtained in such a manner, were added, as an external additive, 2.0 parts of the spherical fine silica particles 1 (spheroidicity=1.12, degree of hydrophobicity=70%) having a volume average particle diameter of 0.2 μm and obtained in Production Example 13, and the resultant mixture was stirred for 5 minutes at 1,200 rpm (peripheral speed=34.5 m/s) by means of a Henschel mixer. In addition, 1.0 part of silica (product of Nippon Aerosil Co., Ltd., trade name "R-104", degree of hydrophobicity=45%), the number average particle diameter of primary particles of which is 12 nm, and 0.5 part of fine silica particles (product of Clariant Co., trade name "HDK-H05TX"; degree of hydrophobicity=80%), the number average particle diameter of primary particles of which is 50 nm, were added while cooling a jacket of the stirrer with water, and the resultant mixture was stirred for 10 minutes at 1,400 rpm to prepare a toner (magenta toner) A. The properties (including properties of the colored resin particles) of this toner A are as shown in Table 1.

Production Example 15

Toner B

Washing was conducted in the same manner as in Production Example 14 except that washing with 250 parts of a 3% aqueous solution of sodium hydrogencarbonate was added after the washing with 250 parts of ion-exchanged water of 40° C. in the washing step for the polymer particles in Production Example 14.

To 100 parts of the colored resin particles obtained in such a manner, were added, as an external additive, 2.0 parts of the spherical fine silica particles 1 (spheroidicity=1.12, degree of hydrophobicity=70%) having a volume average particle diameter of 0.2 μm and obtained in Production Example 13, and the resultant mixture was stirred for 5 minutes at 1,200 rpm (peripheral speed=34.5 m/s) by means of a Henschel mixer. In addition, 0.5 part of silica (product of Nippon Aerosil Co., Ltd., trade name "R-104", degree of hydrophobicity=45%), the number average particle diameter of primary particles of which is 12 nm, and 0.5 part of fine silica particles (product of Clariant Co., was added while cooling a jacket of the stirrer with water, and the resultant mixture was stirred for 10 minutes at 1,200 rpm to prepare a toner B. The properties (including properties of the colored resin particles) of this toner B are as shown in Table 1.

Production Example 16

Toner C

Colored resin particles were prepared in the same manner as in Production Example 14 except that the negative charge control resin 1 (CCR1) in Production Example 14 was changed to the negative charge control resin 2 (CCR2). The three kinds of external additives were added to the resultant colored resin particles in the same manner as in Production Example 14 to prepare a toner C. The properties (including properties of the colored resin particles) of this toner C are as shown in Table 1.

Production Example 17

Toner D

Colored resin particles were prepared in the same manner as in Production Example 14 except that the amount of the negative charge control resin 1 (CCR1) used in Production Example 14 was changed from 3 parts to 1.5 parts. The three kinds of external additives were added to the resultant colored resin particles in the same manner as in Production Example 14 to prepare a toner D. The properties (including properties of the colored resin particles) of this toner D are as shown in Table 1.

Production Example 18

Toner E

Washing was conducted in the same manner as in Production Example 14 except that washing with 250 parts of ion-exchanged water of 40° C. in the washing step for the polymer particles in Production Example 14 was conducted three times. The three kinds of external additives were added to the resultant colored resin particles in the same manner as in Production Example 14 to prepare a toner E. The properties (including properties of the colored resin particles) of this toner E are as shown in Table 1.

Production Example 19

Toner F

A polymerizable monomer composition for core was prepared by stirring, mixing and evenly dispersing 80.5 parts of styrene, 19.5 parts of butyl acrylate, 7 parts of a magenta pigment (product of Clariant Co., trade name "C.I. PIGMENT RED 122"), 0.2 part of a charge control agent (product of Orient Chemical Industries Ltd., trade name "E-84"), 0.3 part of divinylbenzene, 0.8 part of a polymethacrylic ester macromonomer (product of Toagosei Chemical Industry Co., Ltd., trade name "AA6", Tg=94° C.) and 10 parts of dipentaerythritol hexamyristate at 12,000 rpm by means of a homomixer (manufactured by Tokushu Kika Kogyo Co., Ltd., trade name "TK TYPE HOMOMIXER") capable of mixing under high shearing force.

On the other hand, an aqueous solution with 6.9 parts of sodium hydroxide dissolved in 50 parts of ion-exchanged water was gradually added to an aqueous solution with 9.8 parts of magnesium chloride (water-soluble polyvalent metal salt) dissolved in 250 parts of ion-exchanged water with stirring to prepare a colloidal dispersion of magnesium hydroxide. The polymerizable monomer composition of core and additionally 1 part of sodium tetraborate decahydrate were added to the colloidal dispersion of magnesium hydroxide obtained above, and the resultant mixture was stilled and mixed by means of a propeller stirrer to obtain a dispersion of the composition. Then, 4 parts of t-butyl peroxy-2-ethylhexanoate was added to form droplets of the polymerizable monomer composition for core at 21,000 rpm by means of a granulator (manufactured by M-TECHNIQUE Co., Ltd., trade name "CLEARMIX CLM-0.8S"). This composition dispersion, in which the droplets had been formed, was transferred and heated to conduct polymerization. At this time, in order to keep the temperature of the composition dispersion constant at 90° C., the jacket temperature of the polymerization reactor and the internal temperature of the polymerization reaction solution were measured to control the jacket temperature using a cascade control method or the like.

After confirming that a polymerization conversion into a polymer reached almost 100%, 2 parts of methyl methacrylate was added, and an aqueous solution with 0.2 part of 2,2'-azobis[2-methyl-N-(2-hydroxyethyl)-propionamide] (product of Wako Pure Chemical Industries, Ltd., trade name "VA-086") dissolved in 100 parts of ion-exchanged water was additionally added to the reactor to polymerize the monomer, thereby obtaining an aqueous dispersion of polymer particles.

The thus-obtained aqueous dispersion of the polymer particles was washed (at 25° C. for 10 minutes) with sulfuric acid while stirring at room temperature, thereby adjusting the pH of the aqueous dispersion to 4.5. After this aqueous dispersion was filtered and dehydrated, 250 parts of ion-exchanged water of 40° C. was additionally added. After the thus-treated aqueous dispersion was filtered and dehydrated, washing with ion-exchanged water of 40° C. was conducted again.

After the washing, colored resin particles were obtained by drying. To 100 parts of the resultant colored resin particles, were added 1.0 part of silica (product of Nippon Aerosil Co., Ltd., trade name "R-104", degree of hydrophobicity=45%), the number average particle diameter of primary particles of which is 12 nm, 0.5 part of fine silica particles (product of Clariant Co., trade name "HDK-H05TX"; degree of hydrophobicity=80%), the number average particle diameter of primary particles of which is 40 nm, and 2.0 parts of organic fine particles (polystyrene) having a volume average particle diameter of 0.38 μm and a spheroidicity of 1.13 were added at the same time, and the resultant mixture was mixed by means of a Henschel mixer to prepare a toner (magenta toner) F. The properties (including properties of the colored resin particles) of this toner A are as shown in Table 2.

Production Example 20

Toner G

Colored resin particles were prepared in the same manner as in Production Example 19 except that the amount of the charge control agent (product of Orient Chemical Industries Ltd., trade name "E-84") used in Production Example 19 was changed from 0.2 part to 4.5 parts. The three kinds of external additives were added to the resultant colored resin particles in the same manner as in Production Example 19 to prepare a toner G. The properties (including properties of the colored resin particles) of this toner G are as shown in Table 2.

Example 1

Image properties were evaluated by means of a printer modified by fitting the photosensitive drum A, the developing roll A and the cleaning blade A as illustrated in FIG. 1. The results are shown in Table 1.

Examples 2 to 5

Image properties were evaluated in the same manner as Example 1 except that the developing roll, cleaning blade and toner were changed as shown in Table 1. The results are shown in Table 1.

Comparative Examples 1 to 6

Image properties were evaluated in the same manner as Example 1 except that the developing roll, cleaning blade and toner were changed as shown in Table 2. The results are shown in Table 2.

TABLE 1

| | | | Example | | | | |
|---|---|---|---|---|---|---|---|
| | | | 1 | 2 | 3 | 4 | 5 |
| Developing roll | | | Roll A | Roll A | Roll A | Roll A | Roll B |
| Surface brightness | | | 83 | 83 | 83 | 83 | 121 |
| Surface roughness Rz (μm) | | | 6.0 | 6.0 | 6.0 | 6.0 | 6.0 |
| Toner | | | Toner A | Toner B | Toner C | Toner D | Toner E |
| Volume average particle diameter dv (μm) | | | 6.6 | 6.7 | 6.6 | 6.6 | 6.6 |
| Average circularity | | | 0.972 | 0.973 | 0.974 | 0.972 | 0.977 |
| Absolute value of charge level (μC/g) | | | 27 | 25 | 45 | 15 | 30 |
| Amount of toner on photosensitive member (mg/cm$^2$) | | | 0.38 | 0.40 | 0.40 | 0.41 | 0.40 |
| Extract pH | | | 5.8 | 7.0 | 6.3 | 5.8 | 6.1 |
| Cleaning blade | | | Blade A | Blade A | Blade B | Blade A | Blade C |
| Peak value of tan δ | | | 0.82 | 0.82 | 0.80 | 0.82 | 0.83 |
| Peak temperature of tan δ (° C.) | | | 2 | 2 | 7 | 2 | −4 |
| Width at half maximum of tan δ (° C.) | | | 30 | 30 | 32 | 30 | 28 |
| Image properties | Printing density | | | | | | |
| | Initial | | 1.54 | 1.45 | 1.60 | 1.38 | 1.55 |
| | After 2 weeks (30° C./80% RH) | | 1.36 | 1.24 | 1.48 | 1.25 | 1.36 |
| | Durability | N/N | 10000≦ | 10000≦ | 10000≦ | 10000≦ | 10000≦ |
| | | H/H | 8500 | 8500 | 8500 | 7500 | 8500 |
| | Cleaning ability (number of sheets) | L/L | 6000 | 6000 | 6000 | 5500 | 6000 |
| | | N/N | 10000≦ | 10000≦ | 9000 | 9000 | 10000≦ |

TABLE 2

| | Comparative Example | | | | | |
|---|---|---|---|---|---|---|
| | 1 | 2 | 3 | 4 | 5 | 6 |
| Developing roll | Roll A | Roll A | Roll C | Roll D | Roll A | Roll A |
| Surface brightness | 83 | 83 | 230 | 20 | 121 | 121 |
| Surface roughness Rz (μm) | 6.0 | 6.0 | 0.7 | 25.0 | 6.0 | 6.0 |
| Toner | Toner F | Toner G | Toner A | Toner A | Toner A | Toner A |

TABLE 2-continued

| | | | Comparative Example | | | | | |
|---|---|---|---|---|---|---|---|---|
| | | | 1 | 2 | 3 | 4 | 5 | 6 |
| Volume average particle diameter dv (μm) | | | 7.3 | 7.47 | 6.6 | 6.6 | 6.6 | 6.6 |
| Average circularity | | | 0.968 | 0.971 | 0.972 | 0.972 | 0.972 | 0.972 |
| Absolute value of charge level (μC/g) | | | 4 | 90 | 27 | 27 | 20 | 20 |
| Amount of toner on photosensitive member (mg/cm$^2$) | | | 0.38 | 0.41 | 0.40 | 0.41 | 0.39 | 0.38 |
| Extract pH | | | 6.9 | 4.1 | 5.8 | 5.8 | 5.8 | 5.8 |
| Cleaning blade | | | Blade A | Blade A | Blade A | Blade A | Blade D | Blade E |
| Peak value of tan δ | | | 0.82 | 0.82 | 0.82 | 0.82 | 1.00 | 1.00 |
| Peak temperature of tan δ (° C.) | | | 2 | 2 | 2 | 2 | −16 | 12 |
| Width at half maximum of tan δ (° C.) | | | 30 | 30 | 30 | 30 | 23 | 30 |
| Image properties | Printing density | | | | | | | |
| | Initial | | 1.40 | 1.60 | 1.20 | 1.65 | 1.55 | 1.55 |
| | After 2 weeks (30° C./80% RH) | | 1.15 | 1.40 | 1.02 | 1.40 | 1.36 | 1.36 |
| | Durability | N/N | 5000 | 6500 | 9500 | 9500 | 9000 | 10000 |
| | | H/H | 3000 | 4500 | 8000 | 8000 | 8500 | 8500 |
| | Cleaning ability (number of sheets) | L/L | 6000 | 4000 | 5000 | 3000 | 3500 | 3500 |
| | | N/N | 9000 | 9000 | 8500 | 5500 | Turning-up of blade | 9000 |

(Note) In Comparative Example 5 of Table 2, "Turning-up of blade" means that the tip of the cleaning blase was turned up upon continuous printing.

Comparison of the results of Table 1 and Table 2 reveals the following facts. As shown in Examples 1 to 5, when the developing roll having the surface brightness and surface roughness Rz prescribed in the present invention and the cleaning blade having viscoelastic properties prescribed in the present invention are used to conduct printing with the spherical and small-sized toner with the absolute value of charge level of the toner controlled within the range prescribed in the present invention, an image forming method excellent in printing density, excellent in durability even under various environments and moreover excellent in cleaning ability can be provided.

On the other hand, when the absolute value of charge level of the toner is too low (Comparative Example 1), the printing density under a high-temperature and high-humidity environment is easy to be lowered, and the durability is deteriorated under normal-temperature and normal-humidity, and high-temperature and high-humidity environments. When the absolute value of charge level of the toner is too high (Comparative Example 2), the durability is deteriorated under normal-temperature and normal-humidity, and high-temperature and high-humidity environments, and the cleaning ability is lowered under a low-temperature and low-humidity environment. When the developing roll, whose surface brightness is too high and whose surface roughness Rz is too low, is used (Comparative Example 3), the printing density is lowered. When the developing roll, whose surface brightness is too low and whose surface roughness Rz is too high, is used (Comparative Example 4), the cleaning ability is lowered, and in particular, the cleaning ability under a low-temperature and low-humidity environment is deteriorated.

When the viscoelastic properties of the cleaning blade do not fall within the respective ranges prescribed in the present invention (Comparative Examples 5 and 6), turning-up occurs on the cleaning blade, or the cleaning ability is deteriorated under a low-temperature and low-humidity environment.

INDUSTRIAL APPLICABILITY

The image forming method according to the present invention can be utilized in the formation of images using image forming apparatus of an electrophotographic system, such as copying machines and laser beam printers.

The invention claimed is:

1. An image forming method comprising the following steps 1 to 6:

(1) a charging step 1 of charging the surface of a photosensitive member having a layer structure that a photosensitive layer is arranged on an electrically conductive base;

(2) an exposure step 2 of exposing the charged surface of the photosensitive member to a patterned light to form an electrostatic latent image;

(3) a development step 3 of developing the electrostatic latent image on the surface of the photosensitive member in contact with a toner supplied on a developing roll to form a toner image;

(4) a transfer step 4 of transferring the toner image on the surface of the photosensitive member to a transfer material;

(5) a fixing step 5 of fixing the toner image transferred to the transfer material; and (6) a cleaning step 6 of removing the toner remaining on the surface of the photosensitive member after the transfer step by means of a cleaning blade brought into contact with the surface of the photosensitive member, wherein (a) the developing roll has a surface brightness from 60 to 140 and a surface roughness Rz from 3 to 8 μm, wherein the developing roll has a structure that the roll is equipped with a columnar electrically-conductive shaft and an elastic layer covering the surface of the electrically-conductive shaft, and a resin coating layer is further formed on the surface of the elastic layer, and wherein the columnar electrically-conductive shaft includes a metal core, (b) the cleaning blade is a cleaning blade made of a polyurethane elastomer and has a peak value of viscoelasticity tan δ of at most 0.95, a peak temperature of viscoelasticity tan δ from −15 to 10° C., a width at half maximum of viscoelasticity tan δ of at least 25° C., and a hardness in Japanese Industrial Standards from 60 to 90, wherein the polyurethane elastomer making up the cleaning blade is a polyester polyol type polyurethane elastomer, (c) the photosensitive member is a photosensitive drum having a diameter from 20 to 60 mm and a layer structure that an organic photoconductor layer (C) having a thickness from 15 to 100 μm is arranged on a cylindrical aluminum base (A) through a sublayer (B) composed of an alumite layer formed by an anodic oxidation treatment of the surface of the aluminum base or an undercoating layer formed by a resin composition containing an inorganic pigment and having a thickness from 5 to 50 μm, (d) the toner contains colored resin particles having a volume average particle diameter from 4 to 10 μm and an average circularity from 0.950 to 0.995 and an external additive, wherein the toner comprises 0.1 to 2 parts by weight, per 100 parts by weight of colored resin particles, of fine silica particles, the number average particle diameter of primary particles of which is 5 to 20 nm, and 0.5 to 2.5 parts by weight of spherical fine silica particles having a volume average particle diameter from 0.1 to 0.5 μm as external additives, and wherein the colored resin particles are those obtained by a polymerization process, (e) the charge level of the toner on the surface of the photosensitive member after the development is 10 to 45 μC/g in terms of an absolute value, and wherein the amount of the toner on the surface of the photosensitive member after the development is within a range from 0.3 to 0.8 mg/cm$^2$, and (f) the toner shows a pH from 3 to 8 as measured in the form of an extract obtained by a boiling treatment in ion-exchanged water having a pH of 7.

2. The image forming method according to claim 1, wherein a polyester polyol component forming the polyester polyol type polyurethane elastomer contains a side chain-containing glycol component.

3. The image forming method according to claim 1, wherein the organic photoconductor layer (C) is composed of a charge generation layer having a film thickness from 0.01 to 5 μm and a charge transport layer having a film thickness from 5 to 50 μm.

4. The image forming method according to claim 3, wherein the charge transport layer contains a stilbene or butadiene compound as a charge-transporting agent.

5. The image forming method according to claim 1, wherein the cleaning blade is such that fine particles are applied to a surface of the cleaning blade, with which the photosensitive member comes into contact.

6. The image forming method according to claim 5, wherein the average particle diameter of the fine particles is at least 0.1 μm.

7. The image forming method according to claim 5, wherein the amount of the fine particles applied is 1 to 10 mg/cm$^2$.

8. The image forming method according to claim 1, wherein an electric resistance between the metal core of the developing roll and the surface of the developing roll is $10^5$ to $10^9\Omega$.

9. The image forming method according to claim 1, wherein in a number particle diameter distribution of the colored resin particles, a proportion of colored resin particles having a particle diameter not greater than 3 μm is at most 20%.

10. The image forming method according to claim 1, wherein a ratio dv/dp of the volume average particle diameter dv to the number average particle diameter dp of the colored resin particles is 1.0 to 1.3.

11. The image forming method according to claim 1, wherein the colored resin particles are core shell type colored resin particles.

12. The image forming method according to claim 1, wherein the colored resin particles contain polyfunctional ester compounds as a parting agent.

13. The image forming method according to claim 1, wherein the colored resin particles contain a charge control resin as a charge control agent.

14. The image forming method according to claim 1, wherein the toner comprises additionally 0.3 to 2 parts by weight, per 100 parts by weight of colored resin particles, of fine silica particles, the number average particle diameter of primary particles of which is 30 to 60 nm as external additives.

15. The image forming method according to claim 13, wherein the charge control resin includes negative charge control resins.

* * * * *